US007576277B2

(12) United States Patent
Okuyama

(10) Patent No.: US 7,576,277 B2
(45) Date of Patent: Aug. 18, 2009

(54) TUNING DEVICE FOR MUSICAL INSTRUMENTS AND COMPUTER PROGRAM FOR THE SAME

(75) Inventor: Fukutaro Okuyama, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 46 days.

(21) Appl. No.: 11/454,176

(22) Filed: Jun. 15, 2006

(65) Prior Publication Data

US 2006/0288850 A1 Dec. 28, 2006

(30) Foreign Application Priority Data

Jun. 28, 2005 (JP) ..... 2005-188669
Jun. 30, 2005 (JP) ..... 2005-192123

(51) Int. Cl.
*G10G 7/02* (2006.01)

(52) U.S. Cl. ..... 84/454

(58) Field of Classification Search ..... 84/454, 84/DIG. 18

See application file for complete search history.

(56) References Cited

U.S. PATENT DOCUMENTS 3,876,936 A * 4/1975 Lester et al. ..... 324/76.41
4,078,469 A * 3/1978 Calvin ..... 84/454
4,196,652 A * 4/1980 Raskin ..... 84/458
4,429,609 A * 2/1984 Warrender ..... 84/454
5,549,028 A 8/1996 Steinberger
5,619,004 A * 4/1997 Dame ..... 84/616
5,777,248 A 7/1998 Campbell
6,627,806 B1 9/2003 Carpenter
2004/0025672 A1 2/2004 Carpenter

FOREIGN PATENT DOCUMENTS

DE 2152595 4/1973
DE 2524933 12/1976

OTHER PUBLICATIONS www.Behringer.com; "racktuner BTR2000" User's Manual, [online], Apr. 2005, XP002389682, pp. 1-18.
Racktuner BTR2000 User's Manual, Version 1.0, Apr. 2005, pp. 1-18.

* cited by examiner

*Primary Examiner*—Jeffrey Donels
*Assistant Examiner*—Andrew R Millikin
(74) *Attorney, Agent, or Firm*—Harness, Dickey & Pierce, PLC

(57) ABSTRACT

A portable tuning device samples discrete values on a fundamental frequency component of an audio signal, which is equivalent to sound waves produced in a musical instrument, and extracts plural series of fundamental frequency components to be converted to plural bit strings of 1s and 0s; since a time delay equal to the inverse of target frequency is introduced between the first bit of one bit string and the first bit of the next bit string, a series of gradation data has a bit string identical with the bit strings at the consistency with the target frequency, and the series of gradation data has bit strings different from the bit strings at the inconsistency regardless of a cycle time so that user recognizes the tuning state from the bit strings.

14 Claims, 16 Drawing Sheets

TUNING DEVICE FOR MUSICAL INSTRUMENTS AND COMPUTER PROGRAM FOR THE SAME

FIELD OF THE INVENTION

This invention relates to a tuning device and, more particularly, to a tuning device for musical instruments and a computer program installed in the tuning device for tuning musical instruments.

DESCRIPTION OF THE RELATED ART

A typical example of the tuning device for musical instruments is disclosed in Japanese Patent Application laid-open No. Hei 9-257558. The prior art tuning device disclosed in the Japanese Patent Application laid-open determines the pitch of a tone radiated from a musical instrument, and informs users whether or not the pitch of tone is equal to the target pitch already given by the user. The prior art tuning device further indicates how much the deviation is. Using the prior art tuning device, the user tunes up his or her musical instrument.

The prior art tuning device takes the following course in the tuning work. First, the target pitch is assumed to have been already given to the prior art tuning device. When a tone is generated through a musical instrument, the sound waves are taken into the prior art tuning device, and are converted to an audio signal inside the prior art tuning device. The audio signal is level shifted in such a manner as to swing the potential level across zero. When the audio signal changes the potential level from the positive region to the negative region or vice versa, a square pulse signal, which is called as a "reference signal", is changed from the high level corresponding to logic "1" and the low level corresponding to logic "0" or vice versa. Thus, the prior art tuning device digitizes the audio signal.

A delay is repeatedly introduced in the reference signal so that a series of delay signals is produced. The prior art tuning device checks the delay signals to see what delay signal is strongly correlated with the reference signal. When the prior art tuning device finds a delay signal to be strongly correlated with the reference signal, the prior art tuning device determines the amount of delay introduced into the strongly correlated delay signal, and further determines the frequency or pitch of the tone on the basis of the amount of delay.

When the prior art tuning device determines the pitch of the tone, the user is informed of the difference between the target pitch and the pitch of tone on the prior art tuning device.

The prior art tuning devices inform the user of the difference between the target pitch and the pitch of tone in several ways. A prior art tuning device, which is disclosed in Japanese Patent Application laid-open No. Hei 5-313657, informs the user of the difference between the target pitch and the actual pitch of a tone through a lighting pattern of the array of light emitting diodes.

In detail, a row of plural light emitting diodes are provided on the prior art tuning device, and the plural light emitting diodes are selectively energized depending upon the phase difference between the audio signal representative of the pitch of tone and a reference signal representative of the target pitch. The output signals of the counter, which is incremented by the reference signal, are supplied to the switching transistors connected in parallel between the anodes of the light emitting diodes and the power source, and causes the switching transistors to turn on so as to connect the anodes to the power source. The output signal of the low pass filter, which eliminates high-frequency noise components from the audio signal, is supplied to a switching transistor connected between the cathodes of the light emitting diodes and the ground, and causes the switching transistor simultaneously to ground the cathodes to the ground. Therefore, the current flows through the light emitting diodes depending upon the switching transistors.

If the tone has the pitch equal to the target pitch, the switching transistors make selected ones of the light emitting diodes turn on, and prohibit the current from flowing through the other light emitting diodes. On the other hand, if the pitch of the tone is different from the target pitch, phase difference takes place between the reference signal and the audio signal, and the switching transistors between the power source and the anodes are turned on over different time periods. In this situation, the user sees the lighting patter moving on the row of light emitting diodes. Thus, the prior art tuning device notifies the user of the pitch difference through the movement of the lighting pattern on the row of light emitting diodes.

The prior art tuning device makes the user easily know whether or not the musical instrument is exactly tuned at the target pitches through the movement of lighting pattern. However, it is difficult for the user to know how much the actual pitch is different from the target pitch. This is the first problem inherent in the prior art tuning device. As a result, beginners feel the prior art tuning device less helpful.

Another problem is that the user can not discriminate a small amount of pitch difference less than the critical pitch difference. The critical pitch difference is dependent on the circuit configuration, and the user can not change it. In other words, even if the prior art tuning device stops the lighting patter on the row of light emitting diodes, the users with ears feel the musical instrument imperfectly tuned, and feel the frustration to the prior art tuning device.

Yet another problem is that the prior art tuning device fails to notify the user of the pitch difference on the condition that the cycle time for the lighting pattern is equal in length to one of the common multiples between the signal period or repetition period of the audio signal and the target period, i.e., the inverse of the target frequency. In detail, the audio signal 100*a* expresses a tone at the target frequency (see FIG. 1), and the audio signal 100*b* expresses another tone at a pitch different from the target frequency. The lighting patterns 101*a* and 101*b* are schematically expressed in black and white. The black areas stand for the light emitted from the energized light emitting diodes, and the white areas stand for the absence of light.

While the audio signal 100*a* is varying the potential level over the positive threshold of the switching transistor, the switching transistor is turned on, and the cathodes of all the light emitting diodes are grounded through the switching transistor in the on-state, and the light is radiated from the selected ones of the light emitting diodes. When the audio signal 100*a* is decayed below the threshold level, all the light emitting diodes are isolated from the ground, and turn off. Since the cycle time is equal to a multiple of the period of the audio signal, the lighting pattern 101 is repeated as if the lighting pattern stops on the row of light emitting diodes.

The audio signal 100*b* does not have the target pitch, and, accordingly, the prior art tuning device creates the lighting pattern 101*b* different from the lighting pattern 101*a*. The lighting pattern 101*b* is offset from the lighting pattern 101*a*. Although the audio signal 100*b* has the frequency different from the target frequency expressing the target pitch, a multiple of the period of the audio signal 100*b* is also equal to the cycle time. In this situation, the lighting pattern 101*b* is also seen as if it stops on the row of light emitting diodes. From the non-moved lighting pattern 101*b*, the user misunderstands the musical instrument to have been tuned to the target pitch.

SUMMARY OF THE INVENTION

It is therefore an important object of the present invention to provide a tuning device, which exactly accomplishes the tuning work on musical instruments.

It is also an important object of the present invention to provide a computer program, which is installed in the tuning device.

To accomplish the object, the present invention proposes to vary resolution on a gradation image during the tuning work or produce a gradation image in patterns different between consistency and inconsistency.

In accordance with one aspect of the present invention, there is provided a tuning device for tuning a musical instrument to at least one target pitch comprising, a converter converting vibrations representative of a tone produced in the musical instrument to an electric signal representative of the vibrations, an inspector connected to the converter and comparing an actual frequency of the tone with a target frequency of the aforesaid at least one pitch to see whether or not the tone has the aforesaid at least one target pitch for producing an answer, an image producer connected to the inspector, and producing an image expressing the answer on a visual interface, and a resolution controller connected to the image producer and requesting the image producer to vary a resolution of the image.

In accordance with another aspect of the present invention, there is provided a computer program expressing a method for assisting a user in a tuning work on a musical instrument comprising the steps of a) acquiring at least a piece of target data expressing a target pitch, b) analyzing vibrations representative of a tone produced in the musical instrument to see whether or not the tone has the target pitch for producing an answer, c) producing an image expressing the answer on a visual interface at a certain value of resolution, and d) modifying the image on the visual interface at another value of resolution.

In accordance with yet another aspect of the present invention, there is provided a tuning device for tuning a musical instrument to at least one target pitch comprising, a converter converting vibrations representative of a tone produced in the musical instrument to an electric signal representative of the vibrations, a basic image producer connected to the converter and producing plural basic images representative of a repetition period of a certain frequency component incorporated in the tone in such a manner that window time periods of the basic images are partially overlapped with one another, and a composite image producer connected to the basic image producer, superimposing the basic images in such a manner that a delay time is eliminated from between each of the window time periods and the next window time period following the aforesaid each of the window time periods so as to produce a composite image and producing the composite image on a visual interface.

In accordance with still another aspect of the present invention, there is provided a computer program expressing a method for assisting a user in a tuning work on a musical instrument comprising a) acquiring at least a piece of target data expressing a target pitch, b) producing plural basic images representative of a repetition period of a certain frequency component incorporated in the tone in such a manner that window time periods of the basic images are partially overlapped with one another, c) superimposing the basic images in such a manner that a delay time is eliminated from between each of the window time periods and the next window time period following the aforesaid each of the window time periods so as to produce a composite image, and d) producing the composite image on a visual interface.

BRIEF DESCRIPTION OF THE DRAWINGS

The features and advantages of the tuning device and computer program will be more clearly understood from the following description taken in conjunction with the accompanying drawings, in which.

DESCRIPTION OF THE PREFERRED EMBODIMENTS

Figure 1:
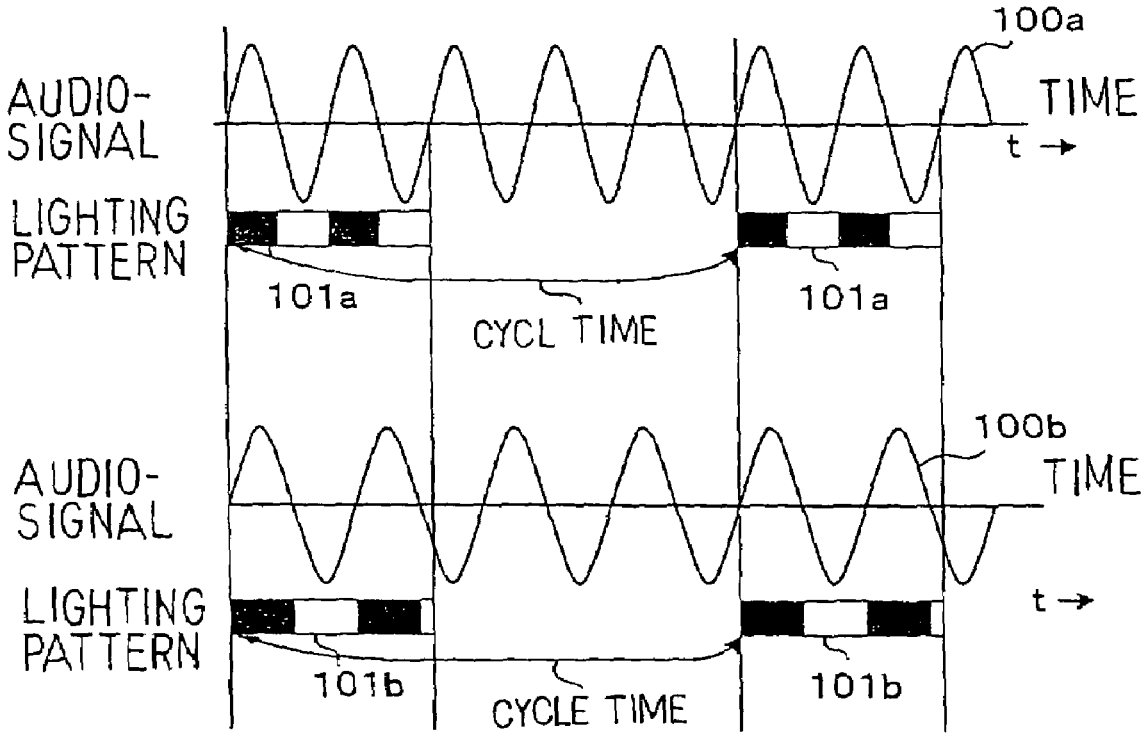
Fig. 1 PRIOR ART
FIG. 1 is a graph showing the waveform of audio signals and the lighting patters produced on the prior art tuning device.

A tuning device embodying the present invention assists a user in a tuning work on a musical instrument. The user accurately tunes the musical instrument to at least one target pitch with the assistance of the tuning device. The tuning device comprises a converter, an inspector connected to the converter, an image producer connected to the inspector and a resolution controller connected to the image producer.

The converter is supplied with vibrations representative of a tone, which is produced in the musical instrument. The converter converts the vibrations to an electric signal representative of the vibrations, and supplies the electric signal to the inspector. The inspector extracts pieces of actual frequency data, which express an actual frequency of the tone, from the electric signal, and compares the pieces of actual frequency data with a piece of target data expressing a target frequency of the at least one pitch to see whether or not the tone has the aforesaid at least one target pitch. The inspector supplies an answer, i.e., a positive answer or a negative answer to the image producer. The image producer produces an image expressing the answer on a visual interface such as a display panel or an array of lighting elements. The user sees the image, and acknowledges current tuning status of the musical instrument.

When the inspector decides the tone to be out of the target pitch, the image expresses the negative answer. On the other hand, when the inspector decides to tone to be found at the target pitch, the image expresses the positive answer. If the tone is widely deviated from the target pitch, the user immediately acknowledges the negative tuning status, and continues the tuning work on the musical instrument. However, if the tone has been already gotten close to the target pitch, the user may feel the image ambiguous. In this situation, the resolution controller cooperates with the image producer to assist the user.

The resolution controller requests the image producer to vary a resolution of the image. The user may instruct the resolution controller to do so. Otherwise, when the tone gets close to the target pitch, the resolution controller automatically requests the image producer to enhance the resolution of the image. Then, the image producer makes the difference between the positive image and the negative image clear. If the difference from the target pitch is expressed in the similarity between the positive image and the negative image, a part of the negative image is, by way of example, magnified so as to make the user notice the difference. If the difference from the target pitch is expressed through the movement of the negative pattern, the image producer speeds up the negative pattern. Thus, the tuning device embodying the present invention makes it possible that the user accurately tunes the musical instrument to the at least one target pitch. Of course, the user may continue to tune the musical instrument to other values of target pitch.

Another tuning device embodying the present invention is also used in a tuning work on a musical instrument. The musical instrument is assumed to be tuned to at least one target pitch. The tuning device comprises a converter, a basic image producer connected to the converter, and a composite image producer connected to the basic image producer.

A user is assumed to start the tuning work. The user produces a tone in the musical instrument. Then, the musical instrument produces vibrations representative of the tone, and the vibrations are supplied to the converter. The converter converts the vibrations to an electric signal representative of the vibrations, and supplies the electric signal to the basic image producer. The basic image producer extracts pieces of actual frequency data expressing a certain frequency component of the tone from the electric signal, and produces plural basic images, which are representative of a repetition period of the certain frequency component incorporated in the tone. The time period occupied by each basic image is referred to as a window time period. The plural basic images are respectively assigned to plural window time periods. While the basic image producer is extracting the pieces of actual frequency data, the basic image producer introduces a delay time among the basic images. The delay time makes the basic images partially overlapped with one another. The delay time is equal to the inverse of the target frequency of the at least one pitch, one of the multiples of the inverse or one of the fractions of the inverse. In other words, the delay time relates to the inverse of the target frequency.

When the basic image producer completes the jobs, the basic images are supplied to the composite image producer. The composite image producer superimposes the basic images in such a manner that a delay time is eliminated from between each of the window time periods and the next window time period following the aforesaid window time period, and produces a composite image. In other words, the basic images are registered with one another for the composite image. As a result, the composite image also occupies the window time period. The composite image producer produces the composite image on a visual interface.

When the tone has the target pitch, the composite image is same as the basic images, because the delay time relates to the inverse of the target frequency. On the other hand, if the actual pitch of the tone is different from the target pitch, a shear or deviation takes place in the superimposition, and the composite image becomes different from the basic images. Even if a cycle time for the composite image is equal to one of the multiples between the inverse of target frequency and the inverse of actual frequency, the shear or deviation takes place among the basic images in so far as the tone does not have the target pitch. Thus, the user surely notices the current tuning status of the musical instrument.

First Embodiment

Figure 2:
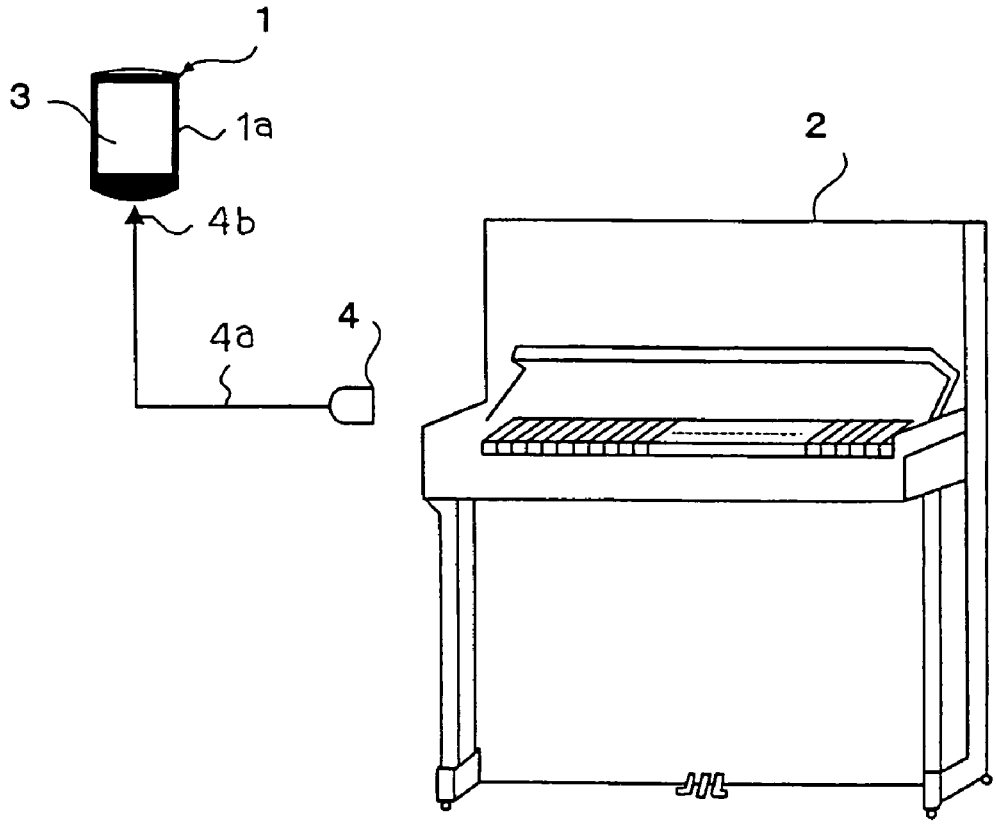
FIG. 2 is a schematic perspective view showing a portable tuning device of the present invention.

Referring first to FIG. 2 of the drawings, a portable tuning device embodying the present invention is provided as a personal digital assistant, which is usually abbreviated as "PDA", and is designated by reference numeral 1. The portable tuning device 1 comprises a housing 1*a*, a data processing system 1*b*, which will be herein later described with reference to FIG. 3, a touch-panel display device 3 and a microphone 4. The data processing system 1*b* is provided inside the housing 1*a*, and the touch-panel display device 3 is set in the housing 1*a*. The microphone 4 is connected to a connecting cable 4*a*, and a plug 4*b*, which is provided on the other end of the connecting cable 4*a*, is inserted in a jack (not shown) on the housing 1*a*.

A user directs the microphone 4 to a musical instrument such as, for example, an upright piano 2, and instructs the portable tuning device to decide whether or not there is found phase difference between an audio signal expressing a tone produced through the upright piano 2 and a reference signal expressing target pitch. If the audio signal is different in period or frequency from the reference signal, the phase difference takes place, and the phrase difference is visualized on the touch-panel display device 3.

The data processing system 1*b* is connected to the touch-panel display device 3, and is further connected to the microphone through the jack (not shown) and connecting cable 4*a*. The touch-panel display device 3 serves as a man-machine interface so that users are communicable with the data processing system 1*b* through the touch-panel display device 3. In this instance, a liquid crystal display panel and a transparent conductive film form in combination the touch-panel display device 3. Tones are converted to an analog audio signal through the microphone 4.

Figure 3:
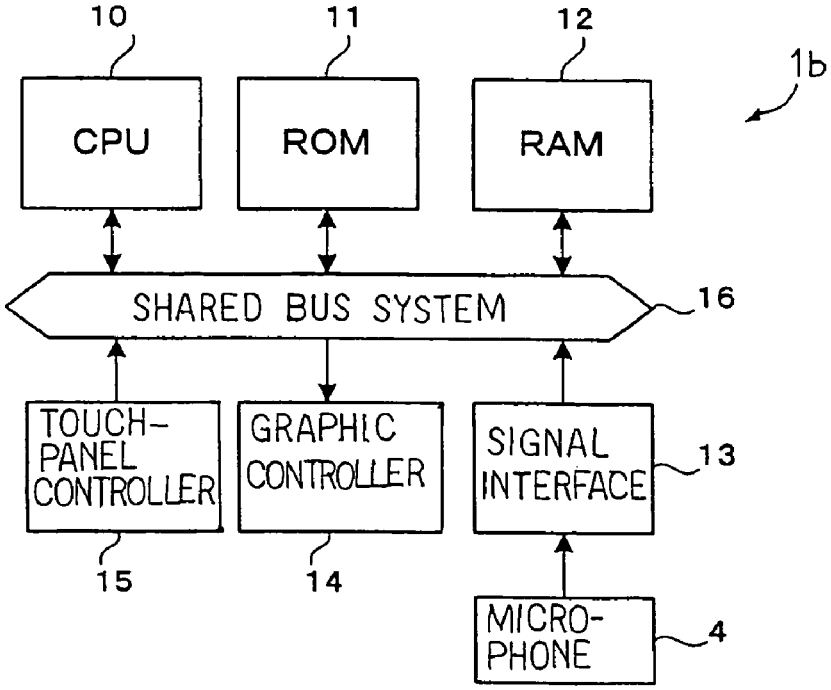
FIG. 3 is a block diagram showing the system configuration of a data processing system incorporated in the portable tuning device.

As shown in FIG. 3, the data processing system 1*b* includes a central processing unit 10, which is abbreviated as "CPU", a read only memory 11, which is abbreviated as "ROM", a random access memory 12, which is abbreviated as "RAM", a signal interface 13, a graphic controller 14, a touch-panel controller 15 and a shared bus system 16. The central processing unit 10, read only memory 11, random access memory 12, signal interface 13, graphic controller 14 and touch-panel controller 15 are connected to the shared bus system 16 so that the central processing unit 10 is communicable with those system components 11, 12, 13, 14 and 15. The central processing unit 10, read only memory 11, random access memory 12 and a part of the shared bus system 16 may be integrated on a monolithic semiconductor chip as a microcomputer.

A computer program is stored in the read only memory 11, and the instruction codes, which form the computer program, are sequentially read out from the read only memory 11 to the shared bus system 16. The computer program includes a main routine program and subroutine programs.

The central processing unit 10 is an origin of the data processing capability, and achieves jobs through the execution of the instruction codes. When a user supplies electric power to the data processing system 1*b*, the main routine program starts to run on the central processing unit 10. The central processing unit 10 firstly initializes the data processing system 1*b*, and waits for a user's instruction. One of the subroutine programs is assigned to assistance in a tuning work on musical instruments. When a user instructs the data processing system 1*b* to assist him or her in the tuning work on a musical instrument, the main routine program starts to run on the central processing unit 10, and periodically branches to the subroutine program. The main routine program and subroutine program will be herein later described in detail.

The random access memory 12 offers a working area to the central processing unit 10. A digital audio signal or a series of audio data codes is accumulated in the random access memory 12 in the tuning work, and the central processing unit 10 examines the series of audio data codes to see whether or not a tone, which is expressed by the series of audio data codes, has an actual pitch equal to a target pitch.

The signal interface 13 has an amplifier and an analog-to-digital converter, and the analog audio signal is supplied from the microphone 4 to the amplifier. The analog audio signal is amplified through the amplifier, and is supplied to the analog-to-digital converter after the amplification. The analog audio signal is sampled at regular time intervals, and the discrete values on the analog audio signal are converted to the audio data codes. The central processing unit 10 periodically fetches the audio data codes from the signal interface 13, and accumulates the audio data codes in the random access memory 12.

The graphic controller 14 is connected to the liquid crystal display panel of the touch-panel display device 3. The graphic controller 14 produces visual images on the liquid crystal display panel under the control of the central processing unit 10. Visual images form pictures, and each picture appears on the liquid crystal display panel over a frame. The images of the pictures will be herein later described in detail. The picture is changed to a new picture or maintained in the next frame. Standard personal digital assistants usually repeat the frames at 15 Hz to 20 Hz. The frame frequency is less than the pitch of the lowest tone produced through the upright piano 2.

The touch-panel controller 15 is connected to the transparent conductive film of the touch-panel display device 3, and cooperates with the graphic controller 14. The touch-panel controller 15 provides a coordinate on the visual images produced on the liquid crystal display panel. When a user pushes a part of the transparent conductive film overlapped with a visual image with a suitable tool such as, for example, a pen, the touch-panel controller 15 determines the visual image on the liquid crystal display panel. In case where the visual images express some instructions, the central processing unit 10 recognizes the user's instruction through the image or images specified by the touch-panel controller 15.

Figure 4A:
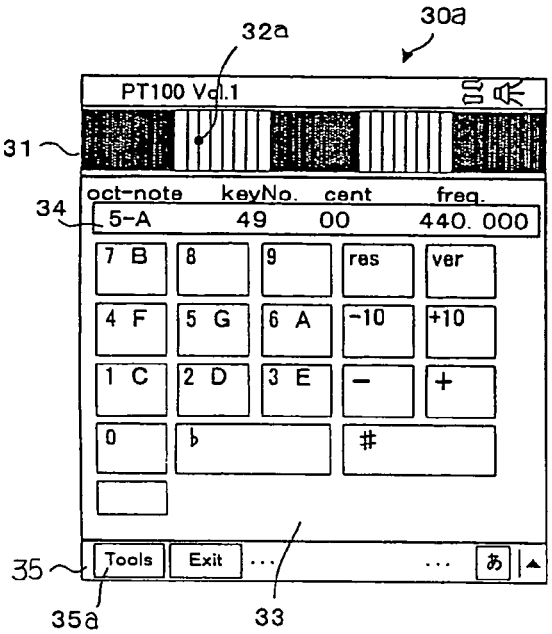
FIGS. 4A and 4B are front views showing pictures produced on a touch panel display device of the portable tuning device.
Figure 4B:
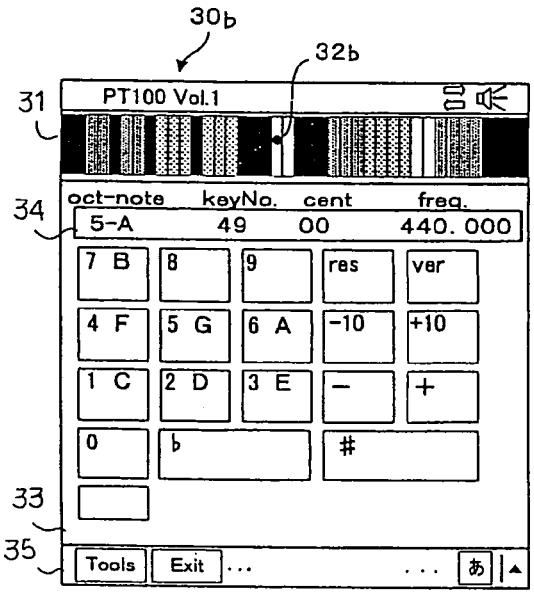

FIGS. 4A and 4B show different pictures 30*a* and 30*b* produced on the touch-panel display device 3. The pictures 30*a* and 30*b* have at least four areas 31, 33, 34 and 35. The area 31 is assigned to gradation images 32*a*, 32*b*, . . . , which express the degree of phase difference of the actual waveform of the analog audio signal from a target waveform. An actual signal period or actual repletion period is determined on the basis of the actual waveform, and the actual waveform has an actual frequency. The target waveform is representative of a target pitch or target frequency to which the musical instrument is to be tuned. At least three tones or shades, i.e., lighter, darker and intermediate shades form the gradation image 32*b*. Two tones form the gradation image 32*a*, and the two-tone gradation image 32*a* expresses the consistency in phase between the waveform of audio signal and the target waveform. On the other hand, when a certain degree of phase difference takes place between the actual signal period or actual repetition period of the audio signal and the inverse of target frequency, the gradation image 32*b*, which is formed by more than two tones, appears in the area 31. If the amount of phase difference is different from that expressed by the gradation image 32*b*, another gradation image, which is also formed by more than two tones, is produced on the touch-panel display device 3 as will be herein later described in detail.

The areas 33 and 35 are assigned to images of button switches. "7B", "8", "9", "res", "ver", "4F", "5G", "6A", "−10", "+10", "1C", "2D", "3E", "−", "+", "0", "b" and "#" are enclosed with rectangles, which express the peripheries of the button switches. The button switches "7B", "4F", "5G", "6A", "1C", "2D" and "3E" are shared between the numerals "7", "4", "5", "6", "1", "2" and "3" and the alphabets "B", "F", "G", "A", "C", "D" and "E". The alphabets express pitch names. Users specify a pitch name and an octave by pressing the button switches with the tool. When a user pushes the button switch "Tools", a job list is displayed on the entire area instead of the images shown in FIGS. 4A and 4B.

The area 34 is assigned to pieces of tuning information. Abbreviations "oct-note", "keyNo.", "cent" and "freq" are labeled with four sub-areas in the rectangle. The abbreviations "oct-note", "keyNo.", "cent" and "freq." and visual images produced below the abbreviations are hereinafter described in detail.

The visual images below the abbreviation "oct-note" express a pitch name assigned a tone to be examined and an octave where the tone belongs. The visual image "5-A" means that the tone to be examined is A. in the fifth octave. Users specify the pitch name and octave by pushing the visual images of corresponding button switches with a finger or a tool. The touch-panel controller 15 determines the coordinate of each visual image pushed with the tool, and informs the central processing unit 10 of the pitch name and octave. Otherwise, another subroutine program periodically runs on the central processing unit 10 for determining the pitch name and octave.

The visual image below the abbreviation "keyNo." expresses the key number of the upright piano 2 assigned the key at "5-A". The upright piano 2 has eighty-eight black and white keys, and the key numbers "1" to "88" are assigned to the eighty-eight black and white keys. The pitch name A in the fifth octaves is assigned to the key with the key number "49".

The visual image below the abbreviation "cent" expresses the interval between two tones. As well know to the persons skilled in the art, a whole tone in the temperament is equivalent to 200 cents, and, accordingly, the semitone is equivalent to 100 cents. When a user wishes to specify a tone offset from the tone "5-A" by a quarter tone, he or she inputs "50" cents through the visual images of button switches. When the visual images of "00" is produced in the sub-area below "cent" as those in FIGS. 4A and 4B, the tone is to be found at A in the fifth octave.

The visual images below the abbreviation "freq." express the target frequency corresponding to the target pitch to which the musical instrument is to be tuned. A frequency, which is corresponding to the designated pitch name, is to be modified with the interval "cent" for the target pitch "freq.". In FIGS. 4A and 4B, numeral images "440.00" is read in the sub-area under the abbreviation "freq" together with the pitch name "5-A" and interval "00". This means that the tone "A" in the fifth octave, which is produced through the musical instrument 2, is to be found at 440.00 hertz.

As will be understood, users can change the pitch name, octave and interval through the manipulation on the images of button switches, and the central processing unit 10 causes the graphic controller 14 to produce the visual images expressing the pitch name, octave and interval in cent below the abbreviations "oct-note" and "cent". However, the central processing unit 10 determines the key number on the basis of the pitch name and octave, and frequency on the basis of the pitch name, octave and interval.

In order to determine the key number and frequency, quickly, the pitch names in several octaves, key number assigned to the black and white keys of a standard piano and fundamental frequency in each standard pitch are correlated with one another in the read only memory 11. When a user inputs a value of the standard pitch, a pitch name and an octave through the touch panel display device 3, the central processing unit 10 determines the pitch name in the given octave on the basis of the coordinates reported from the touch-panel controller 15, and accesses a table, which is assigned to one of the values of the standard pitch, in the read only memory 11 with the pitch name in the given octave. Then, the fundamental frequency and key number are read out from the read only memory 12 to the central processing unit 10. The central processing unit 10 supplies pieces of visual data expressing the pitch name, octave, key number and fundamental frequency to the graphic controller 14, and the visual images are produced in the area 34 under the control of the graphic controller 14.

If the user further inputs the interval from the tone assigned the pitch name, the visual image of which is presently produced in the area 34, the touch-panel controller 15 reports the coordinate of the visual image of button switch pushed by the user to the central processing unit 10, and the central processing unit 10 converts the interval from the cent to the hertz. The central processing unit 10 adds the interval expressed in hertz to the fundamental frequency, and supplies the pieces of visual data expressing the new fundamental frequency to the graphic controller 14. The visual image of interval in cent and visual image of new fundamental frequency are produced in the area 34 under the control of the graphic controller 14.

Figure 5:
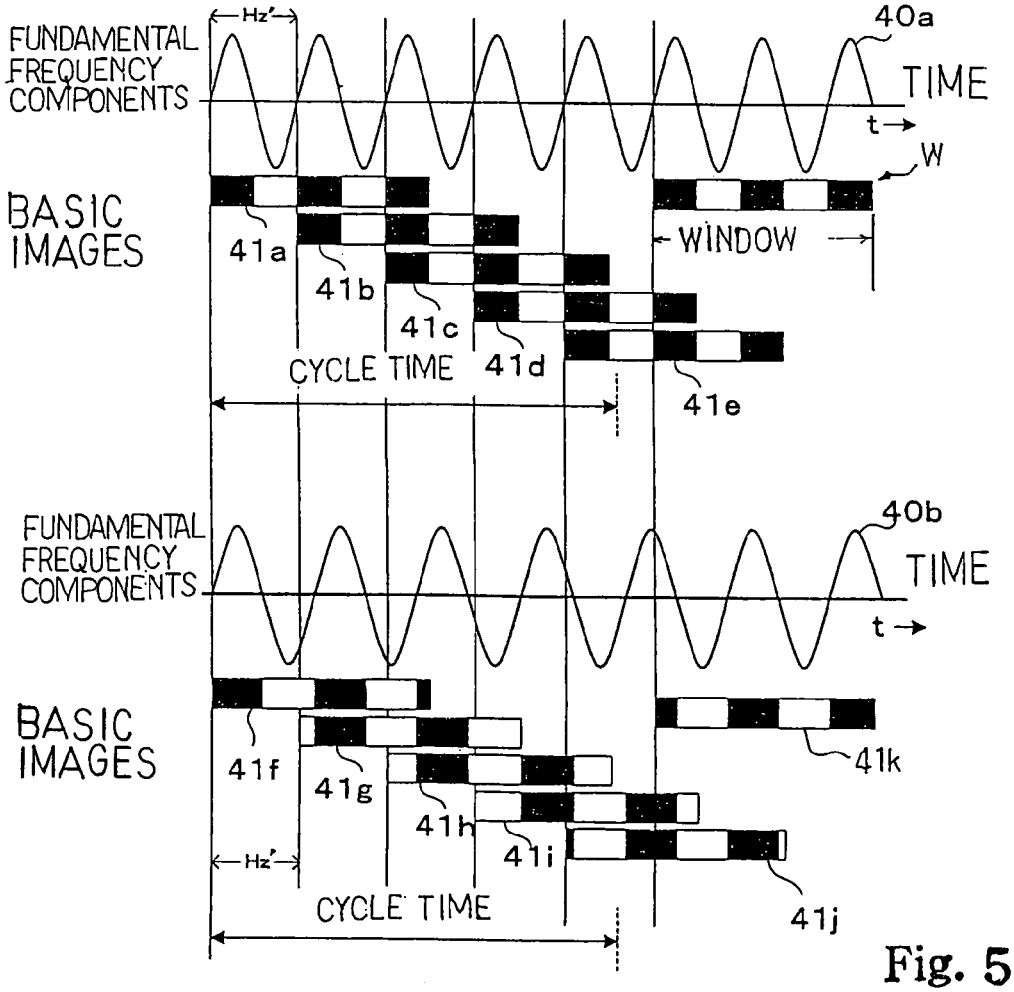
FIG. 5 is a graph showing relation between fundamental frequency components and basic images.

Subsequently, description is made on a method for producing the gradation image 32*a* and 32*b* with reference to FIG. 5. One of the particular features of the method is directed to superimposition of basic images. The gradation image 32*a*/32*b*, which expresses the degree of phase difference between each single waveform of the fundamental frequency component of the audio signal and a single waveform at a target pitch, is produced from the basic images through the superimposition.

Some terms are hereinafter defined for the method according to the present invention. A "cycle time" is equivalent to the time period expressed by the gradation image. A "window" is a time period equal to a product between the inverse of a target frequency Hz and an arbitrary number, and is shorter than the cycle time. Users set a window for the resolution of the gradation image as will be described herein later in detail. The inverse of target frequency Hz is labeled with "Hz'" in FIG. 5, and the window is two and half times longer than the inverse Hz' of target frequency in the graph shown in FIG. 5.

A "basic image" expresses a waveform of the fundamental frequency component, which is equivalent to the actual frequency in this instance, of the audio signal appearing in each window, and a "polarity pattern" repeatedly takes place in the window. The polarity pattern expresses a pair of negative potential region and positive potential region. A part of the polarity pattern, which expresses the negative potential region, and the remaining part of the polarity pattern, which expresses the positive potential region, are referred to as a "negative portion" and a "positive portion", respectively. When the fundamental frequency component of the audio signal changes the potential level from the negative to the positive, the polarity pattern starts. The positive portion continues through the rise and decay of the audio signal, and is terminated at the potential change from the positive to the negative. On the other hand, when the fundamental frequency component of audio signal is changed to negative, the negative portion starts, and is continued until the potential change to the positive.

The portable tuning device 1 firstly samples discrete values on the audio signal, and accumulates the discrete values in the random access memory 12 as pieces of audio data. Subsequently, fundamental frequency component is extracted from the discrete values, and pieces of fundamental frequency data, which express the fundamental frequency component, are accumulated in the random access memory 12. Plural series of pieces of fundamental frequency data are extracted from the accumulated pieces of fundamental frequency data for plural windows. Each of the plural series of fundamental frequency data occupies one of the windows. The piece of fundamental frequency data at the head of a series is delayed from the piece of fundamental frequency data at the head of the previous set by the inverse Hz'. Thus, the delay time, which is equal to the inverse Hz' of target frequency, is introduced between each series of pieces of fundamental frequency data and the next series of pieces of fundamental frequency data.

The plural series of fundamental frequency data are converted to plural series of polarity data, respectively. The pieces of polarity data express the positive potential region and negative potential region of the fundamental frequency component, and are stored in the random access memory 12. Each series of polarity data expresses the basic image. Since the delay time is introduced between a series of pieces of fundamental frequency data and the next series of pieces of fundamental frequency data, each basic image is also delayed from the previous basic image by the time period equal to the inverse Hz' of target frequency, and is partially overlapped with the previous basic image.

Subsequently, the basic images or plural series of pieces of polarity data are registered with or superimposed onto one another. Although the polarity pattern occupies the time period equal to the repetition period of the actual frequency of audio signal, the delay time between the basic images is equal to the inverse Hz' of the target frequency. For this reason, the difference in phase between the actual frequency and the target frequency has an influence on the basic images. When the basic images are superimposed onto one another, each negative pattern and each positive pattern are exactly superimposed on the other negative patterns and the other positive patterns in so far as the signal period or repetition period of the fundamental frequency components of audio signal is equal to the inverse Hz' of target frequency. If the signal period or repetition period is shorter than or longer than the inverse Hz' of target frequency is, the boundary between the negative portion and the positive portion of each basic image is offset from the boundary between the negative portion and the positive portion of the next basic image, and the amount of offset between the adjacent basic images is increased from the first boundary to the last boundary in each cycle time. When the portable tuning device proceeds to the next cycle time, the basic images of the gradation image are changed from those in the present cycle time. As a result, the gradation image looks as if it is slightly moved. While the portable tuning device is repeating the renewal of the gradation image, the user feels as if the gradation image flows from one side toward the other side in the area 31.

Users set the window for the resolution. The shorter the window is, the higher the resolution is. The superimposed basic images, i.e., the gradation image 31*a*/31*b* occupy the whole area 31. In order to produce the gradation image in the whole area 31, the portable tuning device properly magnifies the gradation images, and the magnification ratio is varied depending upon the length of the window.

When a user instructs the portable tuning device to elongate the window, many basic images occupy the window so that the portable tuning device magnifies each basic image at relatively small magnification ratio, because the many basic images are adjusted to the constant length of area 31. On the other hand, when the user instructs the portable tuning device to shorten the window, a few basic images occupies the window so that the portable tuning device magnifies each basic image at relatively large magnification ratio so as to make the gradation image 31*a*/31*b* occupy the whole area 31. Since the basic images are magnified, the amount of offset is also magnified, and the user can discriminate an extremely small amount of offset through the gradation image. Thus, a short window makes the difference in phase between the signal period of the audio signal and the inverse Hz' of target frequency clearly visualized.

Assuming now that a user inputs pitch name of "A" in the fifth octave by selectively pushing the images of button switches in the area 33, the central processing unit 10 determines that the user is to depress the key assigned the key number "49" and that the target pitch is 440.00 hertz. The user is assumed not to input the offset or interval from the target pitch. The central processing unit 10 requests the graphic controller 14 to produce the visual images "5-A", "49", "00" and "440.00" in the area 34 as shown in FIGS. 4A and 4B.

When the user depresses the key assigned the key number of 49, a piano tone is produced inside the upright piano 2, and the sound waves, which express the piano tone, are propagated to the microphone 4. The sound waves are converted to the audio signal by means of the microphone 4, and the audio signal is transferred through the connection cable 4*a* to the signal interface 13.

The audio signal is sampled at regular intervals, which is much shorter than the inverse Hz' of target frequency, and the fundamental frequency component is extracted from the discrete values on the audio signal. The pieces of fundamental frequency data, which express the fundamental frequency component, are accumulated in the random access memory 12. Each of the fundamental frequency components is representative of the audio signal, and is labeled with 40*a* or 40*b* in FIG. 5.

Plural series of pieces of fundamental frequency data are extracted from the accumulated pieces of fundamental frequency data 40*a* and 40*b*. The delay time, which is equal to the inverse Hz' of target frequency, is introduced between each of the plural series of pieces of fundamental frequency data and the next series of pieces of fundamental frequency data.

The plural series of fundamental frequency data are converted to plural series of polarity data. In this instance, the positive discrete values and negative discrete values are replaced with "1" and "0", respectively. A bit string "1" expresses the positive portion of the polarity pattern, and is colored in black in FIG. 5. On the other hand, a bit string "0" expresses the negative portion of the polarity pattern, and is colored in white in FIG. 5. The single signal waveform of the fundamental frequency component 40*a*/40*b* of audio signal forms a pair of positive portion and negative portion so that the pieces of polarity data are expressed as pairs of positive and negative portions.

Since the window is two and half times longer than the inverse Hz' of target frequency, the central processing unit 10 extracts the plural series of pieces of polarity data for the windows, respectively, and the plural series of pieces of polarity data express the basic images 41*a*, 41*b*, 41*c*, 41*d*, 41*e*, . . . or 41*f*, 41*g*, 41*h*, 41*i*, . . . . The delay time, which is equal to the inverse Hz' of target frequency, is introduced between the adjacent two series of pieces of polarity data so that the basic images 41*b*, 41*c*, 41*d*, 41*e*, . . . or 41*g*, 41*h*, 41*i*, 41*j*, . . . are offset from the previous series of polarity data 41*a*, 41*b*, 41*c*, 41*d*, . . . or 41*f*, 41*g*, 41*h*, 41*i* by the inverse Hz' of target frequency.

The fundamental frequency component 40*a* of audio signal swings the potential level at 440.00 hertz so that each signal waveform is equal in length to the inverse Hz' of target frequency. The positive portion is equal in length to half of the wavelength of the fundamental frequency component 40*a* of audio signal, and the negative portion is also equal to the other half of the wavelength of the fundamental frequency component 40*a* of audio signal. For this reason, the boundary between the positive portion and the negative portion is just aligned with the zero-cross point on the time base. Since the window is two and half times longer than the inverse Hz' of target frequency, the basic images 41*a*, 41*b*, 41*c*, 41*d*, 41*e*, . . . exactly occupy the windows, respectively. In other words, each of the basic images 41*a*, 41*b*, 41*c*, 41*d*, 41*e*, . . . is same as the other basic images 41*b*, 41*c*, 41*d*, 41*e* , . . . , 41*a*.

On the other hand, the fundamental frequency component 40*b* of audio signal has the wavelength longer than the inverse Hz' of target frequency so that each of the polarity patterns in the basic images 41*f*, 41*g*, 41*h*, 41*i*, 41*j* . . . becomes longer than the inverse Hz' of target frequency. The boundary between the positive portion and the negative portion is not aligned with the zero-cross point on the time base, and two and half polarity patterns can not occupy the single window. As a result, the ratio between the positive portion and the negative portion in each window is varied, and the boundary between the positive portion and the negative portion is moved together with time.

Figure 6A:
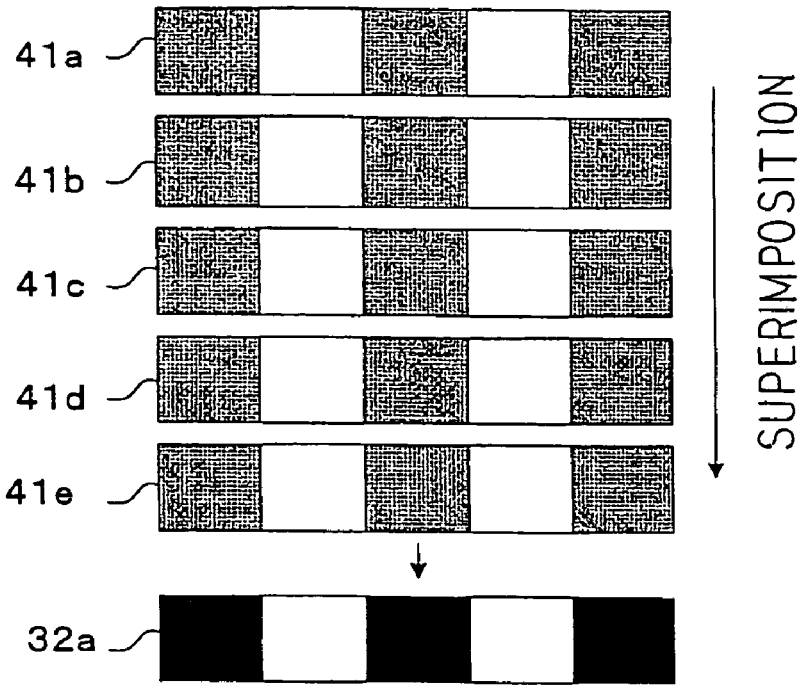
FIGS. 6A, 6B and 6C are views showing different sorts of basic images superimposed on one another.
Figure 6B:
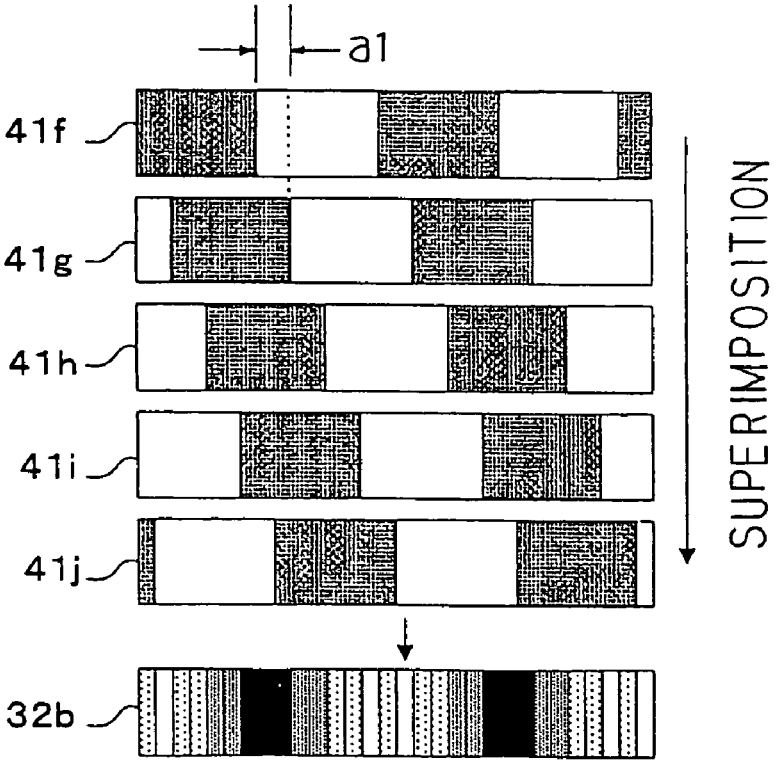

The central processing unit 10 compares the bit pattern of the series of pieces of polarity data with that of the other series of pieces of polarity data as if the images 41*a*, 41*b*, 41*c*, 41*d*, 41*e*, . . . or 41*f*, 41*g*, 41*h*, 41*i*, 41*j*, . . . are superimposed on one another as shown in FIG. 6A or FIG. 6B.

When the upright piano 2 produces the sound waves equivalent to the fundamental frequency component 40*a* of audio signal, the basic images 41*a*, 41*b*, 41*c*, 41*d*, 41*e*, . . . have the boundaries between the positive portions and the negative portions aligned with the boundaries of the other basic images 41*b*, 41*c*, 41*d*, 41*e*, . . . , 41*a*, and the basic images 41*a*, 41*b*, 41*c*, 41*d* and 41*e* are formed into the gradation image 32*a* as shown in FIG. 6A. Although the graphic controller 14 repeatedly produces the gradation image 32*a* in the area 32*a* at the renewal timing under the control of the central processing unit 10, the gradation image 32*a* is same as that in the previous cycle times. Thus, the portable tuning device 1 informs the user that the upright piano 2 has been correctly tuned at the key number 49.

On the other hand, if the upright piano 2 produces the sound waves equivalent to the fundamental frequency component 40*b* of audio signal, the fundamental frequency component 40*b* of audio signal has the signal period longer than the inverse Hz' of target frequency, and, accordingly, the polarity pattern for the fundamental frequency component 40*b* of audio signal becomes longer than that for the fundamental frequency component 40*a* of audio signal. The window is also two and half times longer than the inverse Hz' of target frequency is. As a result, two-odd polarity patterns occupy the window. The delay time is also introduced between the basic images 41*f*, 41*g*, 41*h*, 41*i*, 41*j*, . . . and the next basic images 41*g*, 41*h*, 41*i*, 41*j*, . . . . When the basic images 41*f*, 41*g*, 41*h*, 41*i*, 41*j*, . . . are superimposed on one another as shown in FIG. 6B, the boundaries between the positive portions and the negative portions in the basic images 41*g*, 41*h*, 41*i*, 41*j*, . . . are offset from the boundaries between the positive portions and the negative portions in the basic images 41*f*, 41*g*, 41*h*, 41*i*, 41*j*, . . . by an extremely short time a1. As a result, the basic images 41*f*, 41*g*, 41*h*, 41*i* and 41*j* are formed into the gradation image 32*b*. The gradation image 32*b* is constituted by more than two tones, and is different from the gradation image 32*a*, which expresses the tone at the target pitch.

When the gradation image 32*b* is renewed, the basic images 41*f*, 41*g*, 41*h*, 41*i*, 41*j* are changed to different basic images 41*k*, . . . . Comparing the basic image 41*f* with the basic image 41*k*, it is understood that the boundaries between the positive portions and the negative portions are moved from the basic image 41*f* to the basic image 41*k*. For this reason, the user feels the gradation image 32*b* sidewardly moved in the area 31. While the graphic controller 14 is repeatedly producing the gradation image 32*b*, the user understands the difference from the target pitch through the movement of the gradation image 32*b*.

If the cycle time is equal to one of the common multiples between the signal period of the fundamental frequency component 40*b* of audio signal and the inverse Hz' of target frequency, the gradation images, which represent the difference from the target pitch, do not sidewardly flow in the area 31. However, more than two tones form the gradation images, which represent the difference from the target pitch. As a result, the user recognizes the difference from the target pitch. Thus, the user can determine whether the musical instrument 2 has been tuned at the target pitches on the basis of the number of tones in the gradation images 32*a* and 32*b*.

The user is assumed to feel the difference from the target pitch unclear due to the extremely short distance a1. The user selectively pushes the images of button switches in the areas 34 and 35 so as to shrink the window. In detail, when the user pushes the image of button switch 35*a* "Tools", the job list is displayed on the touch panel display device 3. The user selects "change of window" from the job list. Then, the numeral images expressing typical values of magnification ratio and a visual image of regulation tool are produced. The user pushes one of the numeral images, and manipulates the visual image of regulation tool so as to shrink or elongate the window. Finally, the user pushes a visual image of button switch expressing the determination. Then, the portable tuning device acknowledges the new value for the window.

Figure 6C:
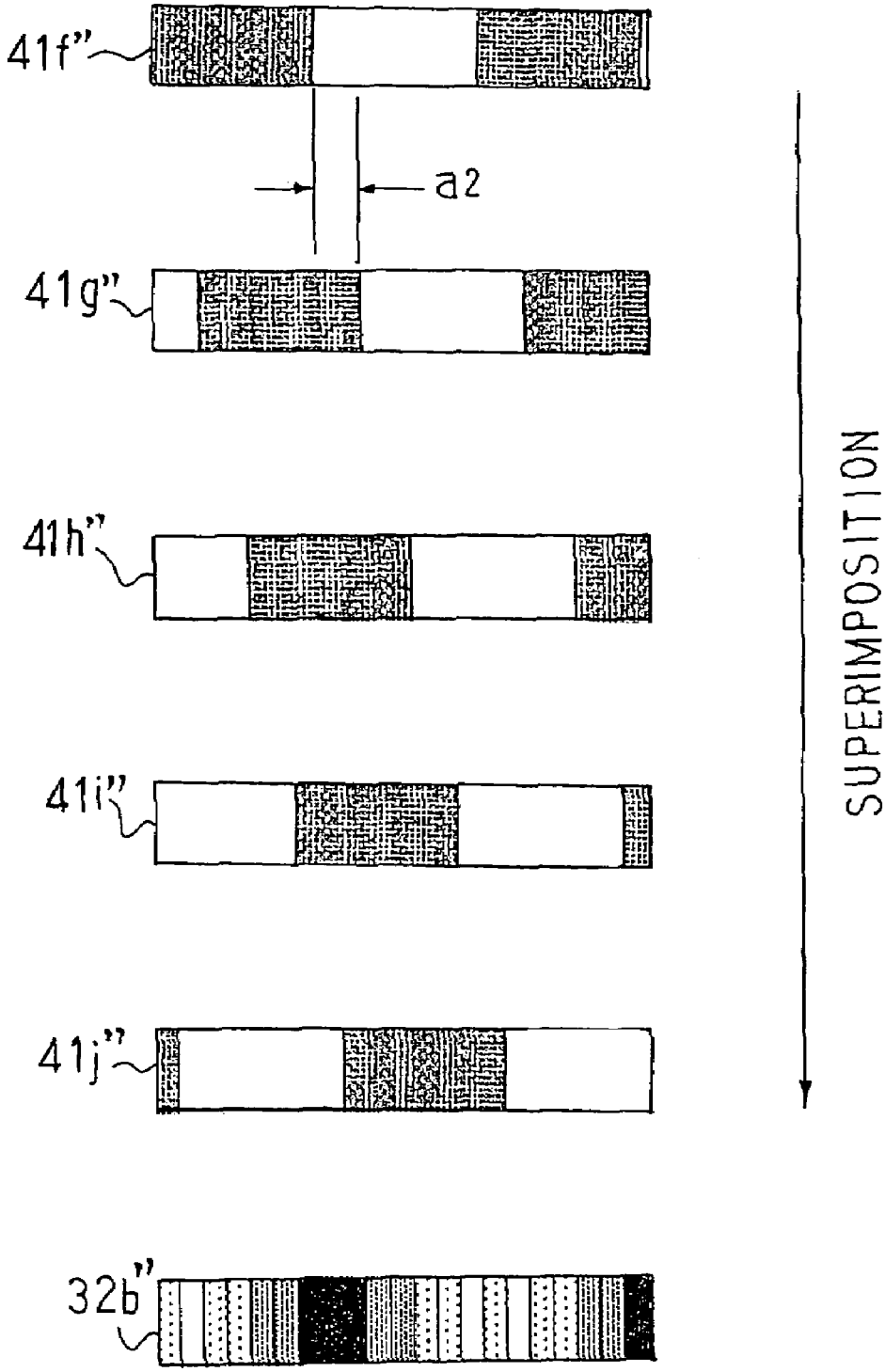

The user is assumed to shrink the window at 70%. While the audio signal, which contains the fundamental frequency components 40*b*, is inputting into the signal interface 13, the central processing unit 10 samples the discrete values on the audio signal 40*b*, and produces basic images 41*f*", 41*g*", 41*h*", 41*i*", 41*j*", . . . . (See FIG. 6C) Since the window is shrunk at 70%, only one pair of positive and negative portions, a positive portion and an extremely short part of a negative portion occupy the window in the basic image, by way of example. The basic images 41*f*", 41*g*", 41*h*", 41*i*" and 41*j*" are superimposed on one another, and are formed into a gradation image 32*b*". Although the gradation image 32*b*" is 70% of the gradation image 32*b*, the central processing unit 10 elongates the gradation image 32*b*" in order to make the gradation image 32*b*" occupy the whole area 31. As a result, the distance between two tones is increased as if the distance between the boundaries between the positive portion and the negative portion is increased from a1 to a2. Thus, the user discriminates the amount of offset from the target frequency by changing the window.

Figure 7:
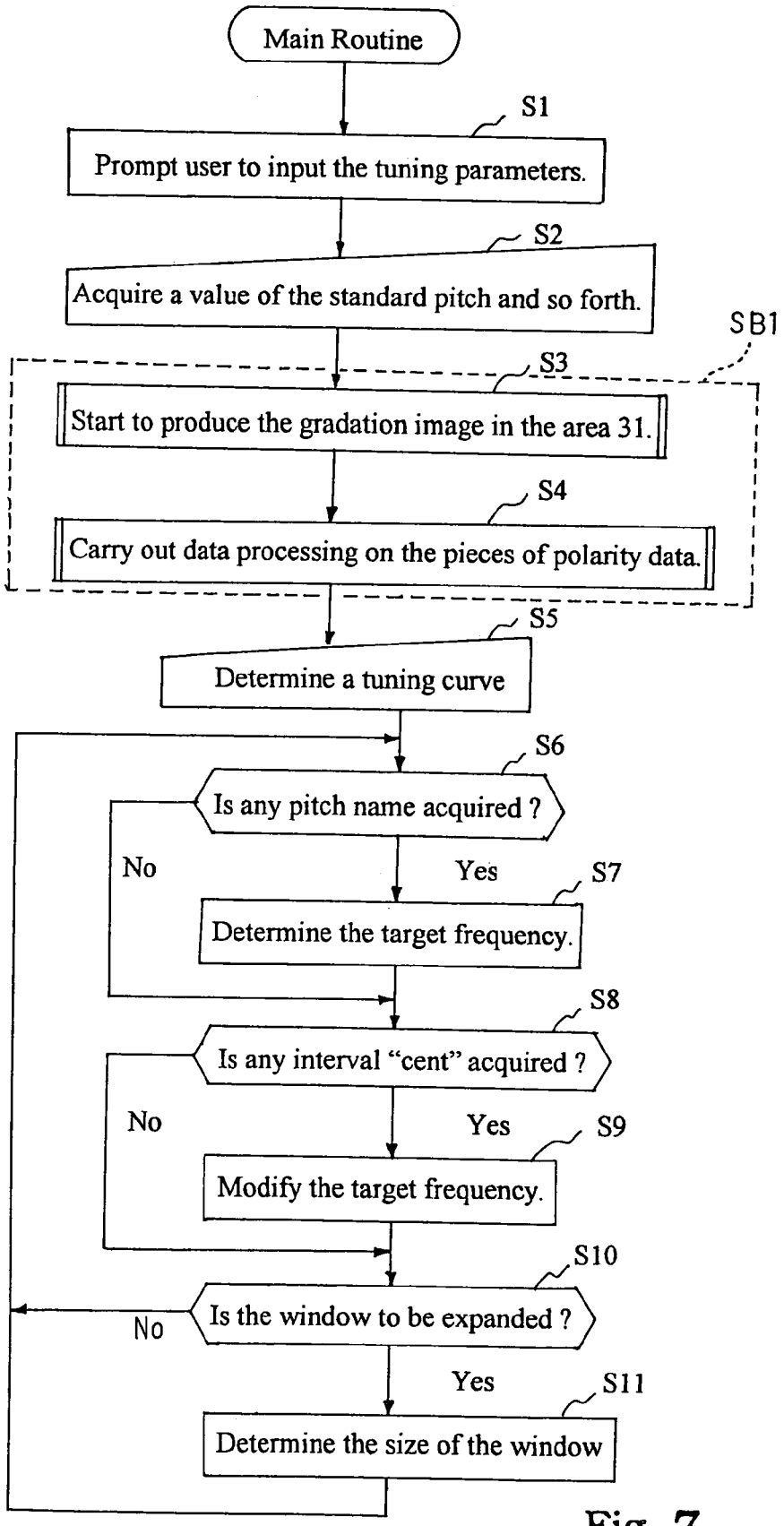
FIG. 7 is a flowchart showing a job sequence in a main routine program.
Figure 8:
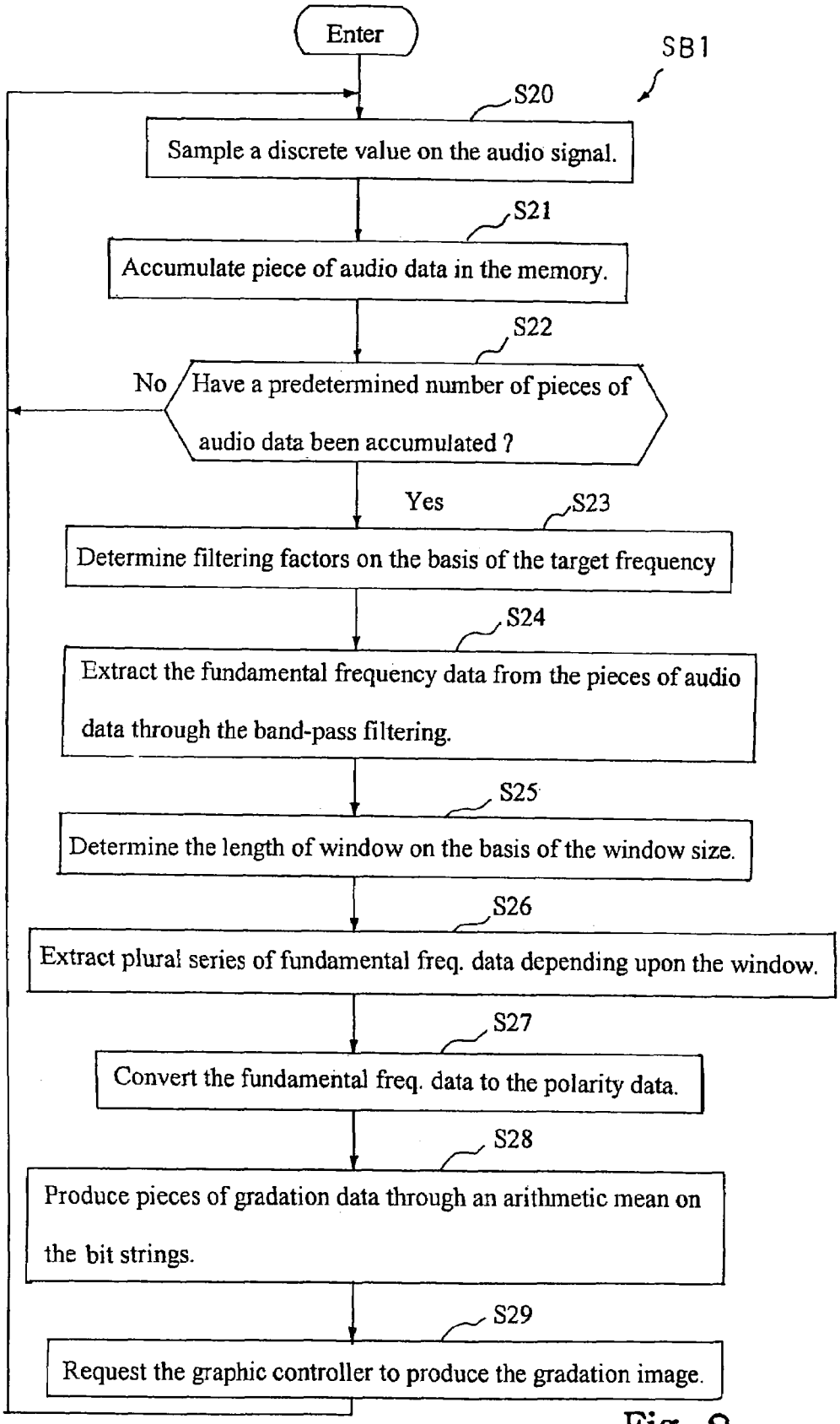
FIG. 8 is a flowchart showing a job sequence in a subroutine program.

The above-described tuning work is realized through execution on the computer program. The computer program is broken down into the main routine program and sub-routine programs as described herebefore. While the main routine program is running on the central processing unit 10, the portable tuning device communicates with a user for jobs to be carried out, and adjusts itself to the conditions given by the user. FIG. 7 shows a part of the main routine program relating to the tuning work on the upright piano 2. One of the subroutine programs SB1 is assigned to the production of the gradation images 32*a*/32*b*, and is illustrated in FIG. 8. The main routine program periodically branches to the subroutine program SB1, and the central processing unit 10 repeatedly produces the gradation images in the cycle times. Although the subroutine program SB1 is inserted between step 2 and step 3 of the main routine program, the main routine program branches to the subroutine program SB1 at every timer interruption regardless of the job in the main routine program.

A user is assumed to turn on the power switch of the portable tuning device 1. The central processing unit 10 initializes the data processing system 1*b*, and communicates with the user for tuning parameters. One of the tuning parameters is a value of the standard pitch. The standard pitch is a frequency at A in the fifth octave to which all the musical instrument and singers relating to an ensemble are to be tuned. There have been proposed several values for the standard pitch such as 440 hertz, 442 hertz, 439 hertz and so forth. Other tuning parameters are the pitch name, interval in cent and a size of window "W".

Upon entry into the tuning work, the central processing unit 10 firstly requests the graphic controller 14 sequentially to produce prompt messages to the user on the touch-panel liquid crystal display device 3 as by step S1. The touch-panel controller 15 informs the central processing unit 10 of the coordinates of the areas pushed by the user, and the central processing unit 10 determines user's instruction, values and options as by step S2. First, the graphic controller 14 produces the numeral images of the candidates of the standard pitch. The user is assumed to push the area where the numeral image "440.000 hertz" is produced. Then, the central processing unit 10 decides the standard pitch to be 440.000 hertz with the assistance of the touch-panel controller 15. The central processing unit 10 further cooperates with the graphic controller 14 and touch-panel controller 15 in similar manners so as to determine the pitch name, interval in cent and size W of window. The user is assumed to input A in the fifth octave, 0 cent and standard size, i.e., 2.5 times to the portable tuning device. The central processing unit 10 acknowledges that the pitch name, interval and size W of window are A in the fifth octave, i.e., 440 hertz, 0 cent and two and half, i.e., 2.5 times longer than the inverse Hz' of the target frequency Hz, respectively.

Upon completion of the jobs at steps S1 and S2, the main routine program gets ready to branch to the subroutine program SB1, and the graphic controller 14 produces the gradation image on the area 31 as by steps S3 and S4. The jobs at steps S3 and S4 are hereinlater described with reference to FIG. 8.

Subsequently, the central processing unit 10 cooperates with the graphic controller 14 and touch-panel controller 15 for a tuning curve as by step S5. The term "tuning curve" means plots indicative of relation between pitch name and target frequency, and plural tuning curves are stored in the read only memory 11 in the form of table. The plural tuning curves or tables express preferable relation between the pitch name and the target frequency for different types of piano such as, for example, the grand piano and upright piano. This is because of the fact that musicians feel tones in the higher register natural at certain values of frequency higher than the standard values of frequency in the temperament. The certain values are varied depending upon the type and model of piano. For this reason, the plural tuning curves are prepared for the piano. One of the tuning curves serves as a default tuning curve so that the default tuning curve is employed for the tuning work in so far as the user does not select another tuning curve. The graphic controller 14 produces images indicative of the plural tuning curve for different types of piano. When the user pushes an area assigned to one of the tuning curves, the touch panel controller 15 informs the central processing unit 10 of the coordinates of the area, and the central processing unit 10 determines the tuning curve.

Subsequently, the central processing unit requests the graphic controller 14 to produce a prompt message, which prompts the user to input a pitch name, and waits for a time. While the prompt message is displaying on the touch-panel liquid crystal display device 3 for the predetermined time period, the central processing unit 10 repeatedly determines whether or not the user inputs a pitch name as by step S6. When the user pushes an area of a pitch name and an area of an octave, the touch-panel controller 15 informs the central processing unit 10 of the coordinates of the areas so that the central processing unit 10 determines the target frequency Hz for the pitch name on the basis of the tuning curve as by step S7. The central processing unit 10 writes the target frequency Hz together with the pitch name in the random access memory 12.

If, on the other hand, the predetermined time period is expired without any data input, the central processing unit 10 proceeds to step S8, and determines whether or not the user inputs the interval in cent into the portable tuning device. In detail, the central processing unit 10 requests the graphic controller 14 to produce a prompt message, which prompts the user to input the interval in cent, and waits for the data input. When the user pushes areas of numeral images, the touch-panel controller 15 informs the central processing unit 10 of the coordinates assigned to the areas, and the central processing unit 10 determines the interval from the selected pitch name. In other words, the central processing unit 10 modifies the target frequency Hz with the interval in cent as by step S9. The central processing unit 10 rewrites the target frequency Hz already stored in the random access memory 12.

If the predetermined time is expired without any data input, the central processing unit 10 proceeds to step S10 without any modification, and determines whether or not the user changes the size W of window. The graphic controller 14 produces the prompt message, and the touch-panel controller 15 checks the touch panel to see whether the user inputs an ordinary size or a large size. When the user inputs the ordinary size W, which is two and half times longer than the inverse Hz' of the target frequency Hz, the touch-panel controller 15 informs the central processing unit 10 of the coordinates of the pushed area, and the central processing unit 10 decides the window to have the ordinary size as by step S11. The central processing unit 10 writes the size of window W in the random access memory 12. If the user does not input the size W during a predetermined time period, the central processing unit 10 keeps the default size, i.e., the ordinary size, and returns to step 6. The user is assumed to select the ordinary size.

The user may firstly tune the piano 2 to the target frequency Hz at the default size W. When the user wishes precisely to tune the piano 2 to the target frequency Hz, the user enlarges the size W. Then, the central processing unit 10 magnifies the gradation image in the area 31, and makes the user recognize delicate difference from the target frequency. As a result, the user precisely tunes the piano 2 to the target pitch.

When the central processing unit 10 changes the length of the window at step S11, the central processing unit 10 also returns to step 6. When the user changes the pitch name, the portable tuning device carries out the tuning work on the piano 2 at the new pitch name through the subroutine program SB1. Thus, the central processing unit 10 reiterates the loop consisting of steps S6 to S11 until the user instructs the portable tuning device to complete the tuning work.

In this instance, the portable tuning device is implemented by a PDA (Personal Digital Assistants). Images on the touch-panel liquid crystal display are renewed at 15 to 20 hertz in the standard PDA. Accordingly, the main routine program branches to the subroutine program SB1 at intervals of 15 to 20 hertz.

The main routine program is assumed to branch the subroutine program SB1. While the microphone 4 is supplying the audio signal to the signal interface 13, the analog-to-digital converter, which is incorporated in the signal interface 13, periodically samples a discrete value on the audio signal, and the discrete value is fetched by the central processing unit 10 as by step S20. In this instance, the sampling frequency is 44.1 kilo-hertz. The central processing unit 10 transfers a piece of audio data, which expresses the discrete value, to the random access memory so as to accumulate the piece of audio data in the random access memory 12 as by step S21.

The central processing unit 10 checks the random access memory 12 to see whether or not a predetermined number of pieces of audio data are found in the random access memory 12 as by step S22. In this instance, the predetermined number is fallen within the range between 1024 and 2048. While the pieces of audio data are being increased toward the predetermined number, the answer at step S22 is given negative "No", and the central processing unit 10 returns to step S20. Thus, the central processing unit 10 reiterates the loop consisting of steps S20 to S22 for increasing the pieces of audio data.

When the pieces of audio data reach the predetermined number, the answer at step S22 is changed to affirmative "Yes". With the positive answer "Yes", the central processing unit 10 determines filtering factors on the basis of the target frequency Hz as by step S23. The filtering factors define the filtering characteristics of a band-pass filter. The bandwidth and center frequency serve as the filtering factors.

Subsequently, the band-pass filtering is carried out on the pieces of audio data so that the fundamental frequency component, which is expressed by pieces of fundamental frequency data, is extracted from the pieces of audio data as by step S24. In other words, the harmonics are eliminated from the pieces of audio data. The pieces of fundamental frequency data are stored in the random access memory 12.

Subsequently, the central processing unit 10 reads out the size of window W from the random access memory 12, and calculates the length of window. As described hereinbefore, the user has inputted the ordinary size, i.e., 2.5 times. The central processing unit 10 reads out the target frequency Hz and the size W from the random access memory 12. The central processing unit 10 determines the inverse Hz' of the target frequency Hz, and multiplies the inverse Hz' by 2.5. Thus, the central processing unit 10 sets the window to (Hz'× 2.5) as by step S25.

Subsequently, the central processing unit 10 extracts plural series of fundamental frequency data from the pieces of fundamental frequency data already stored in the random access memory 12 for the cycle time as by step S26. Each series of fundamental frequency data is adapted to occupy one of the windows. In other words, the length of window is equal to the product between the number of pieces of fundamental frequency data in each series and the sampling period. The time delay is introduced between the first piece of fundamental frequency data of each series and the first piece of fundamental frequency data of the next series, and is equal to the inverse Hz' of target frequency.

Figure 9A:
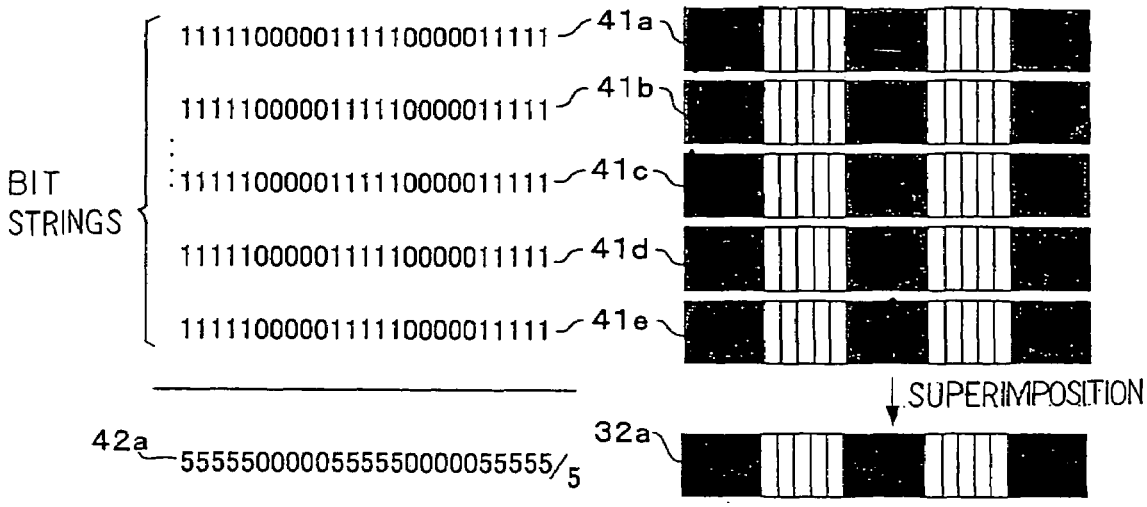
FIGS. 9A and 9B are views showing relation among plural series of pieces of polarity data, basic images, a series of gradation data and a gradation image.
Figure 9B:
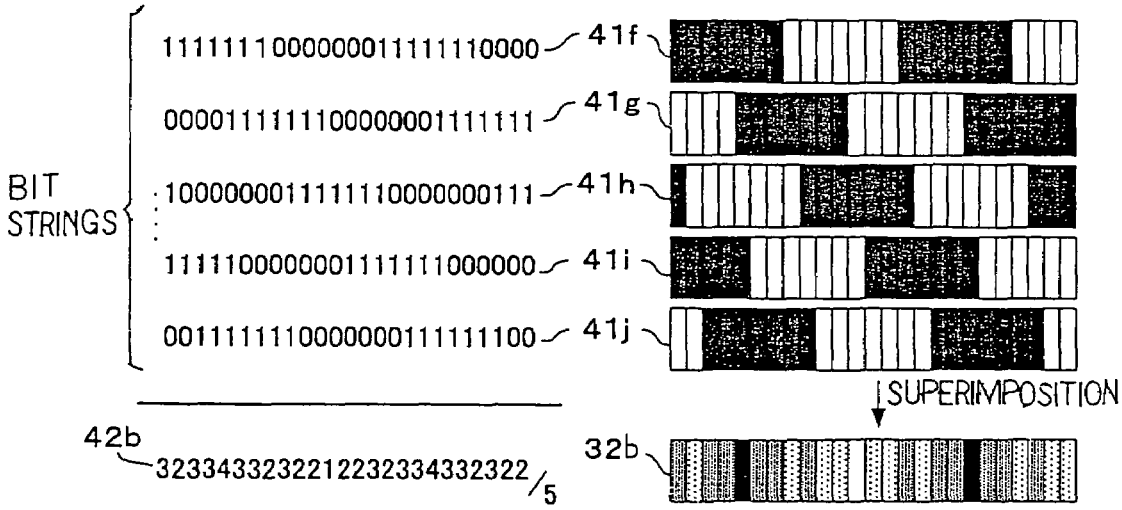

Subsequently, the plural series of fundamental frequency data are respectively converted to plural series of polarity data as by step S27. As described hereinbefore, if pieces of fundamental frequency data have positive numbers, the pieces of fundamental frequency data are replaced with pieces of polarity data expressing binary number "1". On the other hand, if pieces of fundamental frequency data have negative numbers, the pieces of fundamental frequency data are replaced with pieces of polarity data expressing binary number "0". As a result, bit strings are left in the random access memory 12. FIG. 9A shows five bit strings expressing the basic images 41*a*, 41*b*, 41*c*, 41*d* and 41*e*, and FIG. 9B shows five bit strings, which are different from those shown in FIG. 9A, and the five bit strings express the basic images 41*f*, 41*g*, 41*h*, 41*i* and 41*j*. In this instance, each series contains twenty-five pieces of polarity data, and twenty-five addresses are respectively assigned to the twenty-five pieces of polarity data. The twenty-five pieces of polarity data are respectively converted to twenty-five bits, and the twenty-five bits are written in the twenty-five memory locations respectively assigned the twenty-five addresses. Thus, the twenty-five bits form each bit string, which is corresponding to one of the basic images. Since each bit has either "1" or "0", the basic images is expressed by two tones, i.e., black and white.

Subsequently, the central processing unit 10 superimposes the basic images 41*a* to 41*e* or 41*f* to 41*j* through the arithmetic mean of the bit strings. The arithmetic mean on the basic images 41*a* to 41*e* or bit strings 41*a* to 41*e* results in pieces of gradation data 42*a*, i.e., (5555500000555550000055555)/5, and the arithmetic mean on the basic images 41*f* to 41*j* results in pieces of gradation data 42*b*, i.e., (3233433232212232334332322)/5. Thus, the central processing unit 10 produces the pieces of gradation data through the arithmetic mean on the bit strings 41*a* to 41*e* or 41*f* to 41*i* as by step S28.

Finally, the central processing unit 10 supplies the pieces of gradation data 42*a* or 42*b* to the graphic controller 14, and the graphic controller 14 produces the gradation image 32*a* or 32*b* on the area 31 as by step S29. Since the fundamental frequency of audio signal 40*a* is equal to the target frequency Hz, the bit strings 41*a* to 41*e* are equal to one another, and the pieces of gradation data 42*a* is expressed by the bit string same as the bit strings 41*a* to 41*e*. Accordingly, the graphic controller 14 produces the two-tone gradation image 32*a* from the pieces of gradation data 42*a*.

On the other hand, the fundamental frequency of audio signal 40*b* is less than the target frequency Hz so that the bit strings 41*f* to 41*j* are different from one another. As a result, more than two different numbers express the pieces of gradation data 42*b*. For this reason, the graphic controller 14 produces more than two tones in the gradation image 32*b*.

Thus, the main routine program periodically branches to the subroutine program SB1, and the gradation image 32*a* or 32*b* is periodically renewed in the area 31. When the user feels the gradation image 32*a* or 32*b* vague, he or she gives the positive answer "Yes" at step S10, and inputs a different size into the portable tuning device. Then, the length of window becomes less than 2.5, and the central processing unit 10 instructs the graphic controller 14 to produce the gradation image 32*b*' at a large magnification ratio at step S29. The gradation image 32*b*' occupies the entire area 31. Thus, the portable tuning device makes the user clearly see the difference from the target frequency Hz.

When the audio signal has the fundamental frequency 40*a* equal to the target frequency Hz, the gradation image 32*a* is repeatedly produced in the area 31 in a series of frames, and the gradations do not change the relative positions in the area 31. For this reason, the gradation image 32*a* looks as if it stops at the position in the area 31.

If the audio signal has the fundamental frequency greater than or less than the target frequency Hz, the user sees the gradation image moving in the area 31 or constituted by more than two tones. In detail, in case where the cycle time is equal to a common multiple between the inverse of the actual frequency and the inverse Hz' of target frequency, the gradation image looks as if it stops regardless of the consistency between the actual frequency and the target frequency. Nevertheless, the gradation image is still constituted by more than two tones. For this reason, the user recognizes the inconsistency by the aid of the gradation image constituted by more than two tones. When the cycle time is not equal to the common multiples, the user sees the gradation image, which is constituted by more than two tones, moving in the area. Thus, the user surely recognizes the inconsistency in so far as the fundamental frequency is different from the target frequency Hz.

The fundamental frequency is assumed to get close to the target frequency Hz. The portable tuning device 1 slows down the gradation image, and the user feels it difficult to determine whether or not the gradation image still moves. In this situation, the user instructs the portable tuning device 1 to expand a part of the gradation image so that the portable tuning device laterally magnifies the part of gradation image in the area 31. Accordingly, the tones of gradation image are laterally moved faster than previous tones were. Then, the user recognizes the inconsistency between the actual frequency and the target frequency Hz, and continues the tuning work on the piano 2.

As will be understood from the foregoing description, the user accurately tunes the musical instrument to the target frequency Hz by virtue of the gradation image variable in size.

Modifications of First Embodiment

A modification of the first embodiment automatically changes the size of window W. The modification is also implemented by a PDA, and has the exterior arrangement and system configuration shown in FIGS. 2, 3, 4A and 4B.

A computer program employed in the modification is different from that of first embodiment. For this reason, description is focused on the computer program.

Figure 10A:
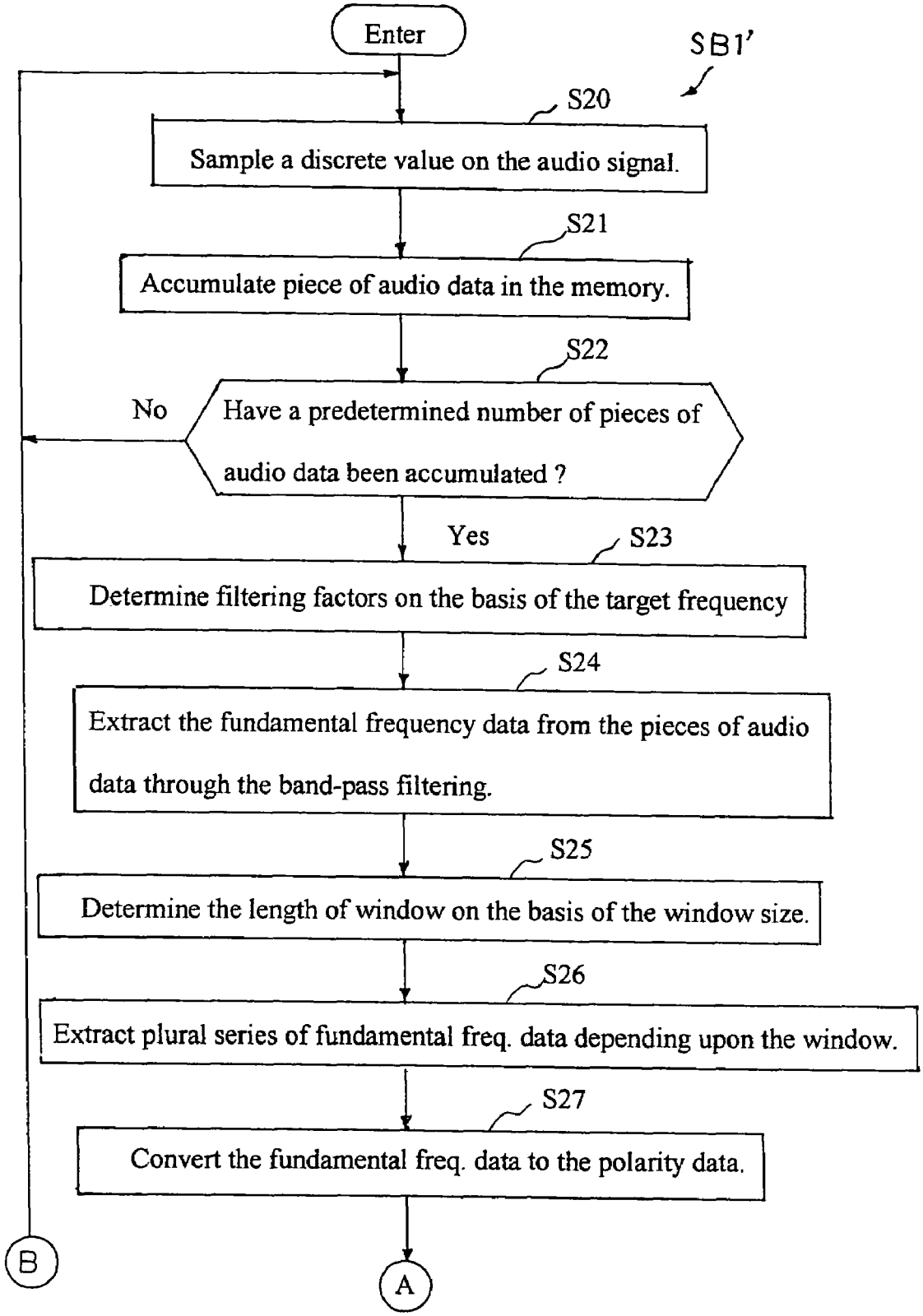
FIGS. 10A and 10B are flowcharts showing a job sequence employed in a modification of the portable tuning device.
Figure 10B:
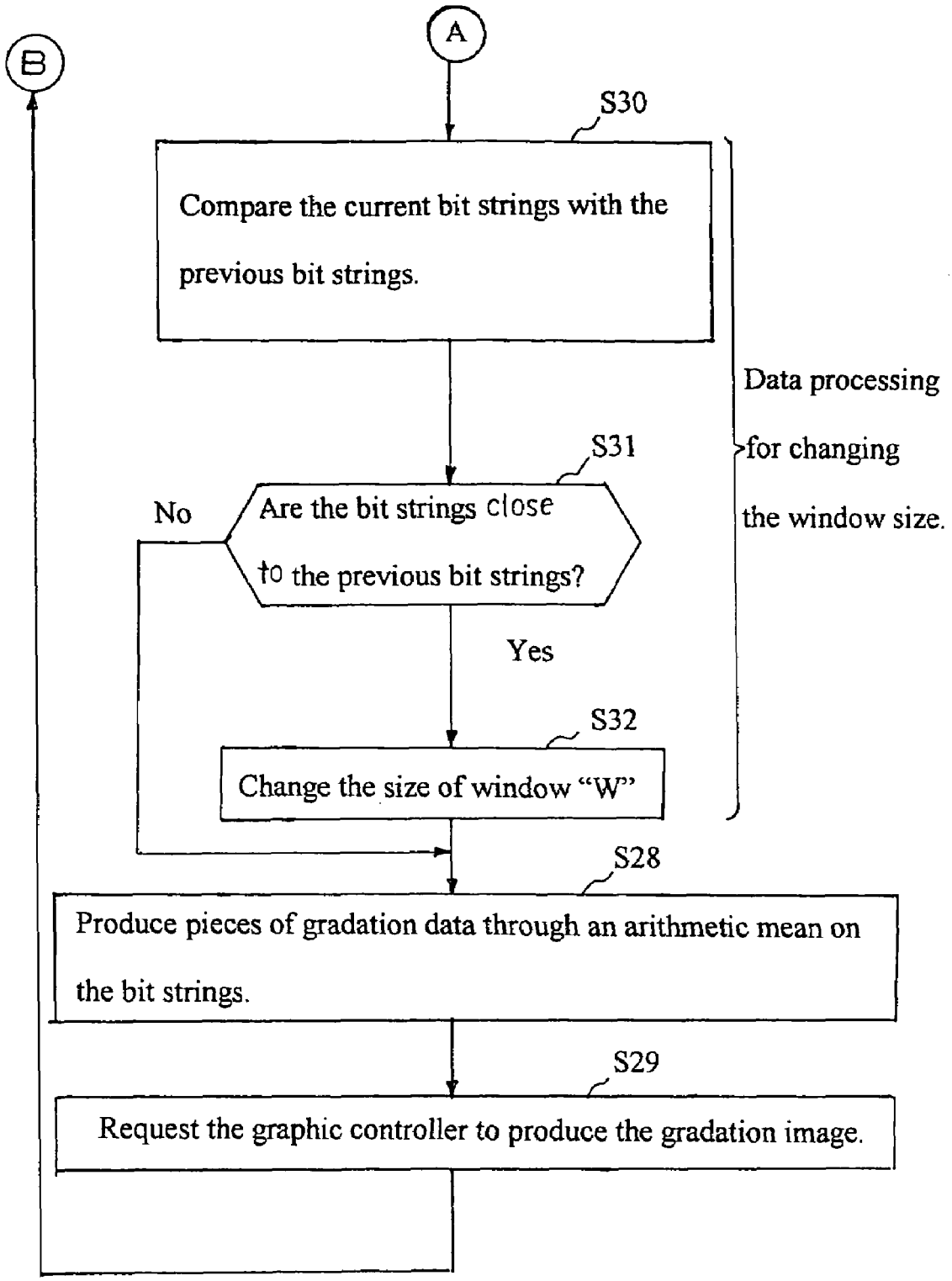

The computer program employed in the modification is also broken down into a main routine program and subroutine programs. Although the main routine program is similar to the main routine program shown in FIG. 7, a subroutine program SB1' for the gradation images is different from the subroutine program as shown in FIGS. 10A and 10B. Although the subroutine program SB1' has steps S20 to S29 as similar to the subroutine program SB1, steps 30, 31 and 32 are newly added. The jobs at steps S20 to S29 are similar between the subroutine program SB1 and the subroutine program SB1', and, for this reason, description on steps S20 to S29 is deleted from the following description for the sake of simplicity. Jobs at newly added steps 30 to 32 are herein below described in detail.

When the central processing unit 10 completes the conversion from the series of pieces of fundamental frequency data to the pieces of polarity data at step S27, the central processing unit 10 memorizes the pieces of polarity data or bit strings in the random access memory 12. Since the central processing unit 10 has stored the previous bit strings in the random access memory 12, the central processing unit 10 compares the current bit strings with the previous bit strings as by step S30, and determines whether or not the current bit strings are close to the previous bit strings as by step S31.

If the fundamental frequency is getting close to the target frequency Hz, different bits are decreased, and the movement of gradation image is slow down in the area 31. In this situation, the answer at step S31 is given affirmative "Yes". The user usually desires to expand the gradation image, and checks the expanded gradation image to see whether or not the fundamental frequency is strictly equal to the target frequency Hz. For this reason, the central processing unit 10 automatically changes the size of window W so as to make the resolution high. The user confirms the consistency between the fundamental frequency and the target frequency Hz on the basis of the expanded gradation image as by step S32.

If, on the other hand, the fundamental frequency is widely different from the target frequency Hz, a lot of bits of the current bit string are different from the corresponding bits of the previous bit string, and the answer at step S31 is given negative "No". In this situation, it is desirable to keep the window long, because the user easily sees the gradation image moving in the area 31. For this reason, the central processing unit 10 proceeds to step S28 without changing the size of window W.

As will be understood from the foregoing description, the portable tuning device automatically changes the size of the gradation image when the fundamental frequency gets close to the target frequency Hz. Even though the user is not familiar with the tuning work on the musical instrument, the portable tuning device guides the user in the tuning work, and makes it possible accurately to tune the musical instrument to the target frequency Hz.

In the first embodiment and modification thereof, the user selects one of the two sizes, i.e., the ordinary size and large size. In the second modification, the portable tuning device may permit users to change the gradation image to one of more than two sizes. The portable tuning device may produce visual images indicative of more than two recommendable sizes. Otherwise, the portable tuning device prompts the user to input an arbitrary size by selectively pushing the images of the numeral buttons.

In the first embodiment and modification thereof, each series of pieces of fundamental frequency data or each basic images 41*a*, 41*b*, 41*c*, 41*d*, 41*e*, 41*f*, 41*g*, 41*h*, 41*i* or 41*j* occupies the time period two and half times longer than the inverse Hz' of target frequency, and the delay time, which is equal to the inverse Hz', is introduced between the piece of fundamental frequency data at the head of a series and the piece of fundamental frequency data at the head of the next series. In the third modification, each series of pieces of fundamental frequency data may occupy a time period shorter than or longer than the above-described time period in so far as the resolution is shorter than the cycle time. The delay time equal to the inverse Hz' does not set any limit to the present invention. The delay time may be longer than the time period occupied by each series of pieces of fundamental frequency data. The number of series of pieces of polarity data to be superimposed may be greater than or less than 5 in so far as the superimposed basic images are same only on the condition that the fundamental frequency is equal to the target frequency Hz.

In the fourth modification, the series of fundamental frequency data may be converted to series of multi-valued data expressing more than two values.

In the fifth modification, the pieces of gradation data may be produced through an addition or multiplication.

In the first embodiment, the main routine program branches to the subroutine program SB1 at the time intervals equal to the cycle time. When the cycle time is expired, the main routine program may branch to the subroutine program SB1. Otherwise, a timer is prepared for the timing to branch to the subroutine program SB1.

In the sixth modification, a tuning device may express the relation between the fundamental frequency and the target frequency through difference in tint, difference in luminance or steps, i.e., difference in height.

In the seventh modification, the difference between the fundamental frequency and the target frequency Hz may be expressed colored patterns. Although a certain colored pattern, i.e., a pattern in a certain color stands for the consistent state, the degree of the inconsistency is expressed by the pattern in different colors. The central processing unit simply produces a pattern from a series of fundamental frequency data or a series of polarity data, and colors the pattern depending upon the degree of inconsistency with the target frequency Hz.

In the eighth embodiment, the computer program shown in FIGS. 7 and 8 is loaded in a personal computer system equipped with a microphone.

In the ninth embodiment, an LED (Light Emitting Diode) driver is incorporated in the electronic system, and the central processing unit requests the LED driver selectively to energize the LEDs. Thus, the difference is expressed by the light selectively radiated from the LEDs of the array.

In the tenth modification, the computer program for the tuning work may be stored in a suitable information storage medium, and is offered to users. Otherwise, users download the computer program from a source through a communication network.

In the first embodiment, the length of windows is reduced for increasing the resolution on the gradation images. However, the resolution is enhanced through various methods. For example, a part of the series of gradation data may be expanded so as to occupy the area 31 in the eleventh modification. Even if a series of polarity data is used as the series of gradation data, the resolution is enhanced through the extraction from the series of gradation data. Thus, the superimposition is not an indispensable feature of the present invention.

Second Embodiment

Figure 11:
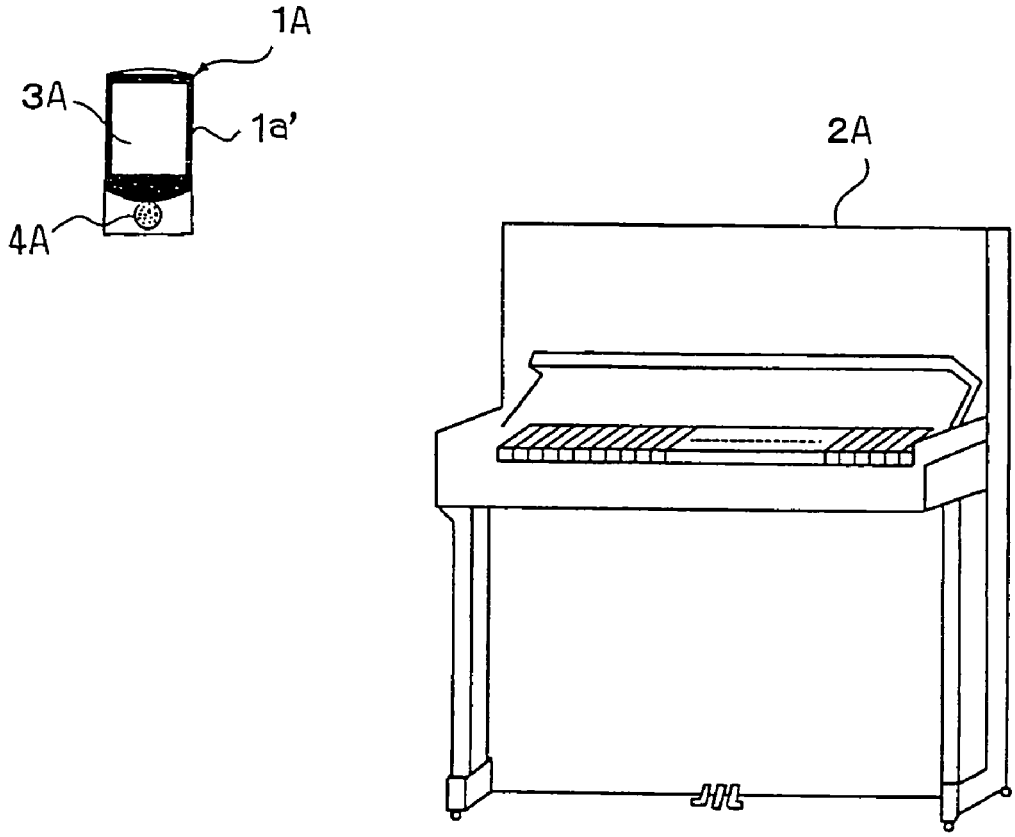
FIG. 11 is a schematic perspective view showing another portable tuning device according to the present invention.

Turning to FIG. 11 of the drawings, another portable tuning device 1 A is illustrated together with a piano 2A. The portable tuning device 1A comprises a housing 1*a*', a data processing system 1*b*, a touch-panel liquid crystal display device 3A and a built-in microphone 4A. The data processing system 1*b* is installed in the housing 1*a*', and the touch-panel liquid crystal display device 3A and built-in microphone 4A are exposed onto the front surface of the housing 1*a*'. The touch-panel liquid crystal display device 3A and built-in microphone 4A are similar to the touch-panel liquid crystal display device 3 and microphone 4 so that no further description is hereinafter incorporated.

Figure 12:
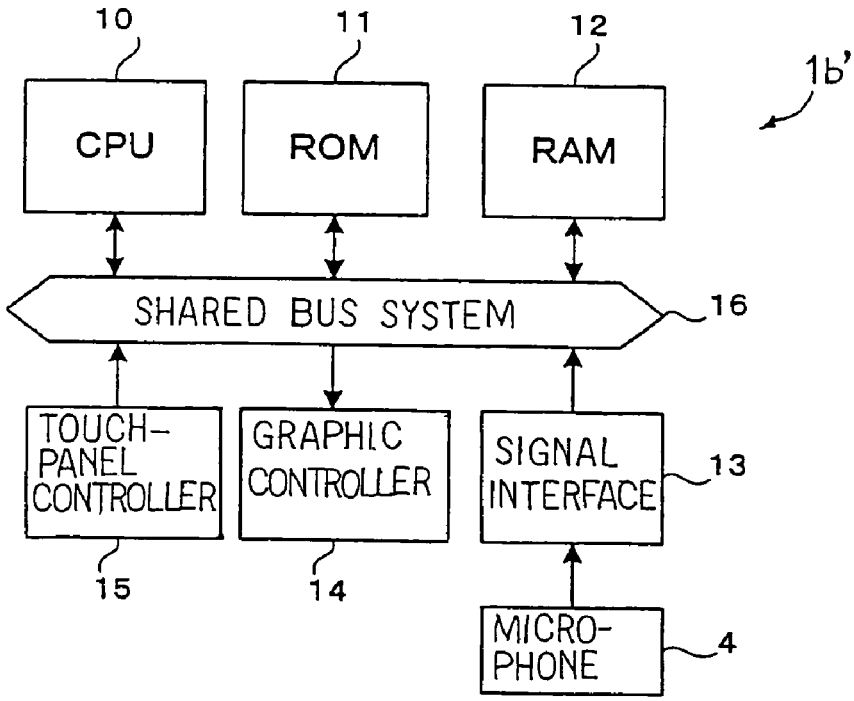
FIG. 12 is a block diagram showing the system configuration of a data processing system incorporated in the portable tuning device.

The system configuration of the data processing system 1*b*' is illustrated in FIG. 12, and is similar to that of the data processing system 1*b*. For this reason, system components of the data processing system 1*b*' are labeled with references designating the corresponding system components of the data processing system 1*b* without detailed description.

Figure 13A:
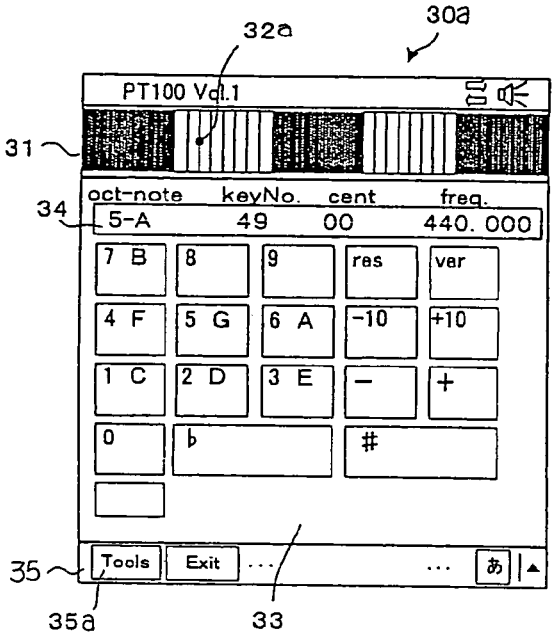
FIGS. 13A and 13B are front views showing pictures produced on a touch panel display device of the portable tuning device.
Figure 13B:
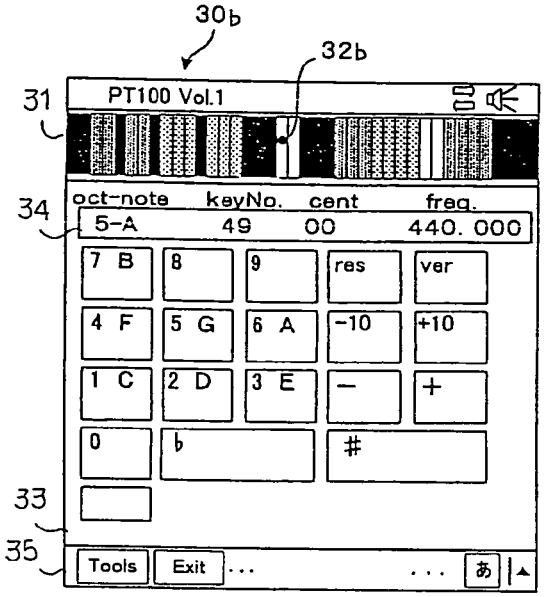

A user is communicable with the data processing unit 10 with the assistance of the graphic controller 14 and touch-panel controller 15. The graphic controller 14 produces visual images on the touch-panel liquid crystal display device 3A as shown in FIGS. 13A and 13B, and the user selectively pushes the images of button switches. The coordinates of the sub-areas pushed by the user are reported from the touch-panel controller 15 to the central processing unit 10, and the central processing unit 10 determines user's instruction. The visual images on the touch-panel liquid crystal display device 3A are same as those on the touch-panel liquid crystal display device 3 so that detailed description is omitted for the sake of simplicity.

A computer program runs on the central processing unit 10 for assisting a user in tuning work on the piano 2A. The computer program is broken down into a main routine program and subroutine programs, and one of the subroutine programs SB1' periodically runs on the central processing unit 10 for reporting current status in the tuning work to the user.

Figure 14:
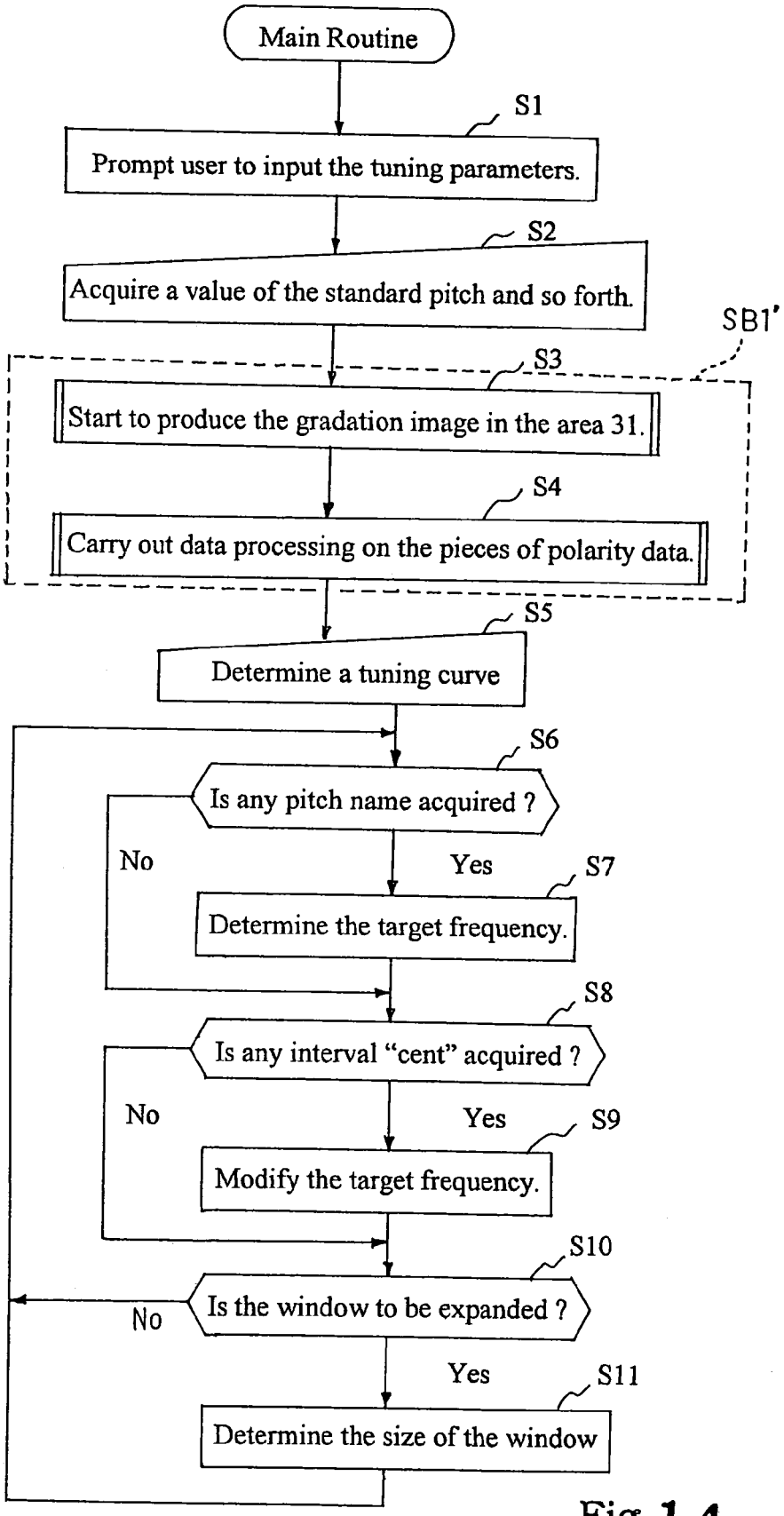
FIG. 14 is a flowchart showing a job sequence in a main routine program.
Figure 15:
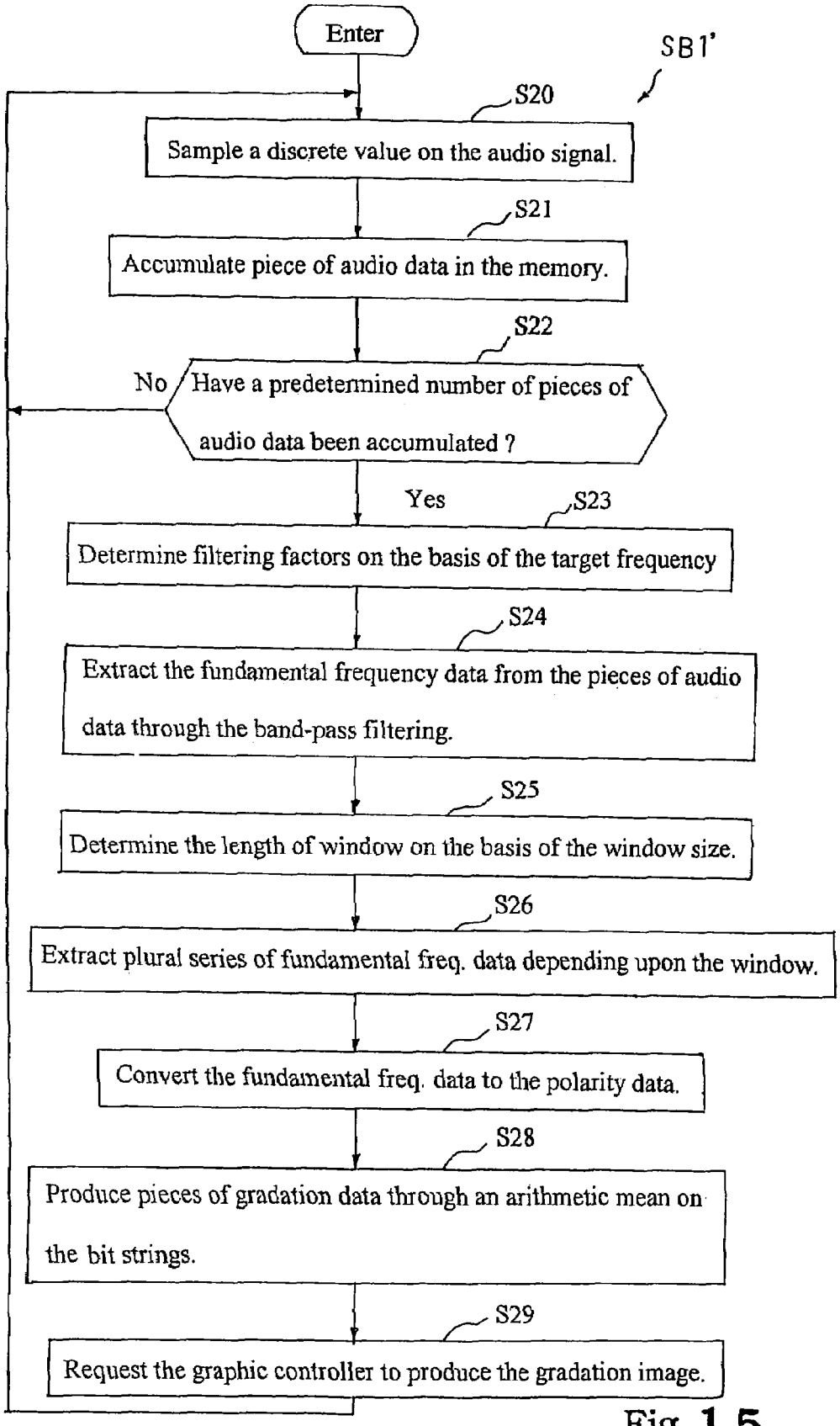
FIG. 15 is a flowchart showing a job sequence in a subroutine program.

FIG. 14 shows a part of the main routine program, and FIG. 15 shows the subroutine program SB1'. The main routine program expresses a job sequence S1 to S11, which is similar to the job sequence of the main routine program shown in FIG. 7. The subroutine program SB1' includes steps S20 to S29, and the steps S20 to S29 are similar to those of the subroutine program SB1. For this reason, description is made on correlation between the computer jobs and the visual images on the touch-panel liquid crystal display device 3A.

A user is assumed to turn on the power switch of the portable tuning device. The central processing unit 10 initializes the system, and communicates with the user for tuning parameters.

Upon entry into the tuning work, the central processing unit 10 firstly requests the graphic controller 14 sequentially to produce prompt messages to the user on the touch-panel liquid crystal display device 3A as by step S1. The touch-panel controller 15 informs the central processing unit 10 of the coordinates of the areas pushed by the user, and the central processing unit 10 determines user's instruction, values and options as by step S2. First, the graphic controller 14 produces the numeral images of the candidates of the standard pitch. The user is assumed to push the area where the numeral image "440.000 hertz" is produced. Then, the touch-panel controller 15 decides the standard pitch to be 440.000 hertz. The central processing unit 10 cooperates with the graphic controller 14 and touch-panel controller 15 in similar manners so as to determine the target frequency Hz, interval in cent and size W of window. The user is assumed to input 440 Hz, 0 cent and 2.5 times to the portable tuning device. The central processing unit 10 acknowledges that the target frequency Hz, interval and size W of window are 440 hertz, 0 cent and two and half, i.e., 2.5 times longer than the inverse Hz' of the target frequency Hz, respectively.

Upon completion of the jobs at steps S1 and S2, the main routine program gets ready to branch to the subroutine program SB1', and the graphic controller 14 produces the gradation image on the area 31 as by steps S3 and S4. The jobs at steps S3 and S4 are hereinlater described with reference to FIG. 16.

Subsequently, the central processing unit 10 cooperates with the graphic controller 14 and touch-panel controller 15 for a tuning curve as by step S5. The graphic controller 14 produces images indicative of the plural tuning curve for different types of piano. When the user pushes an area assigned to one of the tuning curves, the touch-panel controller 15 informs the central processing unit 10 of the coordinates of the area, and the central processing unit 10 determines the tuning curve.

Subsequently, the central processing unit requests the graphic controller 14 to produce a prompt message, which prompts the user to input a pitch name, and waits for a time. While the prompt message is displaying on the touch-panel liquid crystal display device 3 for the predetermined time period, the central processing unit 10 repeatedly determines whether or not the user inputs a pitch name as by step S6. When the user pushes an area of a pitch name and an area of an octave, the touch-panel controller 15 informs the central processing unit 10 of the coordinates of the areas so that the central processing unit 10 determines the target frequency Hz for the pitch name on the basis of the tuning curve as by step S7. The central processing unit 10 writes the target frequency Hz together with the pitch name in the random access memory 12.

If, on the other hand, the predetermined time period is expired without any data input, the central processing unit 10 proceeds to step S8, and determines whether or not the user inputs the interval in cent into the portable tuning device. In detail, the central processing unit 10 requests the graphic controller 14 to produce a prompt message, which prompts the user to input the interval in cent, and waits for the data input. When the user pushes areas of numeral images, the touch-panel controller 15 informs the central processing unit 10 of the coordinates assigned to the areas, and the central processing unit 10 determines the interval from the selected pitch name. In other words, the central processing unit 10 modifies the target frequency Hz with the interval in cent as by step S9. The central processing unit 10 rewrites the target frequency Hz already stored in the random access memory 12.

If the predetermined time is expired without any data input, the central processing unit 10 proceeds to step S10 without any modification, and determines whether or not the user changes the size W of window. The graphic controller 14 produces the prompt message, and the touch-panel controller 15 checks the touch panel to see whether the user inputs an ordinary size or a large size. When the user inputs the ordinary size W, which is two and half times longer than the inverse Hz' of the target frequency Hz, the touch-panel controller 15 informs the central processing unit 10 of the coordinates of the pushed area, and the central processing unit 10 decides the window to have the ordinary size as by step S11. The central processing unit 10 writes the size of window W in the random access memory 12. If the user does not input the size W during a predetermined time period, the central processing unit 10 keeps the default size, i.e., the ordinary size, and returns to step 6. The user is assumed to select the ordinary size.

When the central processing unit 10 changes the length of the window at step S11, the central processing unit 10 also returns to step 6, and repeats steps S6 to S11. When the user changes the pitch name, the portable tuning device carries out the tuning work on the piano 2 at the new pitch name through the subroutine program SB1. Thus, the central processing unit 10 reiterates the loop consisting of steps S6 to S11 until the user instructs the portable tuning device to complete the tuning work.

In this instance, the main routine program branches to the subroutine program

SB1 at intervals of 15 to 20 hertz. The user depresses the white key assigned the pitch name "A" of the fifth octave, and sound waves are radiated from the piano 2A. Then, the main routine program is assumed to branch the subroutine program SB1.

While the microphone 4 is supplying the audio signal to the signal interface 13, the analog-to-digital converter, which is incorporated in the signal interface 13, periodically samples a discrete value on the audio signal, and the discrete value is fetched by the central processing unit 10 as by step S20. In this instance, the sampling frequency is 44.1 kilo-hertz. The central processing unit 10 transfers a piece of audio data, which expresses the discrete value, to the random access memory 12 so as to accumulate the piece of audio data in the random access memory 12 as by step S21.

The central processing unit 10 checks the random access memory 12 to see whether or not a predetermined number of pieces of audio data are found in the random access memory 12 as by step S22. In this instance, the predetermined number is fallen within the range between 1024 and 2048. While the pieces of audio data are being increased toward the predetermined number, the answer at step S22 is given negative "No", and the central processing unit 10 returns to step S20. Thus, the central processing unit 10 reiterates the loop consisting of steps S20 to S22 for increasing the pieces of audio data.

When the pieces of audio data reach the predetermined number, the answer at step S22 is changed to affirmative "Yes". With the positive answer "Yes", the central processing unit 10 determines filtering factors on the basis of the target frequency Hz as by step S23. The filtering factors define the filtering characteristics of a band-pass filter. The band width and center frequency serve as the filtering factors.

Subsequently, the band-pass filtering is carried out on the pieces of audio data so that the fundamental frequency components, which are expressed by pieces of fundamental frequency data, are extracted from the pieces of audio data as by step S24. In other words, the harmonics are eliminated from the pieces of audio data. Plots 40*a*' and 40*b*' stand for the fundamental frequency data in FIG. 16. The fundamental frequency data 40*a*' are produced when the fundamental frequency is equal to the target frequency Hz. On the other hand, the fundamental frequency data 40*b*' is produced when the fundamental frequency is equal to the target frequency Hz. The pieces of fundamental frequency data are stored in the random access memory 12.

Subsequently, the central processing unit 10 reads out the size of window W from the random access memory 12, and calculates the length of window. As described hereinbefore, the user has inputted the ordinary size "2.5". The central processing unit 10 reads out the target frequency Hz' and the size W from the random access memory 12. The central processing unit 10 determines the inverse Hz' of the target frequency Hz, and multiplies the inverse Hz' by "2.5". Thus, the central processing unit 10 sets the window to (Hz'×2.5) as by step S25.

Subsequently, the central processing unit 10 extracts plural series of fundamental frequency data from the pieces of fundamental frequency data already stored in the random access memory 12 as by step S26. Each series of fundamental frequency data is adapted to occupy one of the windows. In other words, the length of window is equal to the product between the number of pieces of fundamental frequency data in each series and the sampling period. However, the time delay is introduced between the first piece of fundamental frequency data of each series and the first piece of fundamental frequency data of the next series, and is equal to the inverse Hz' of target frequency.

Figure 16:
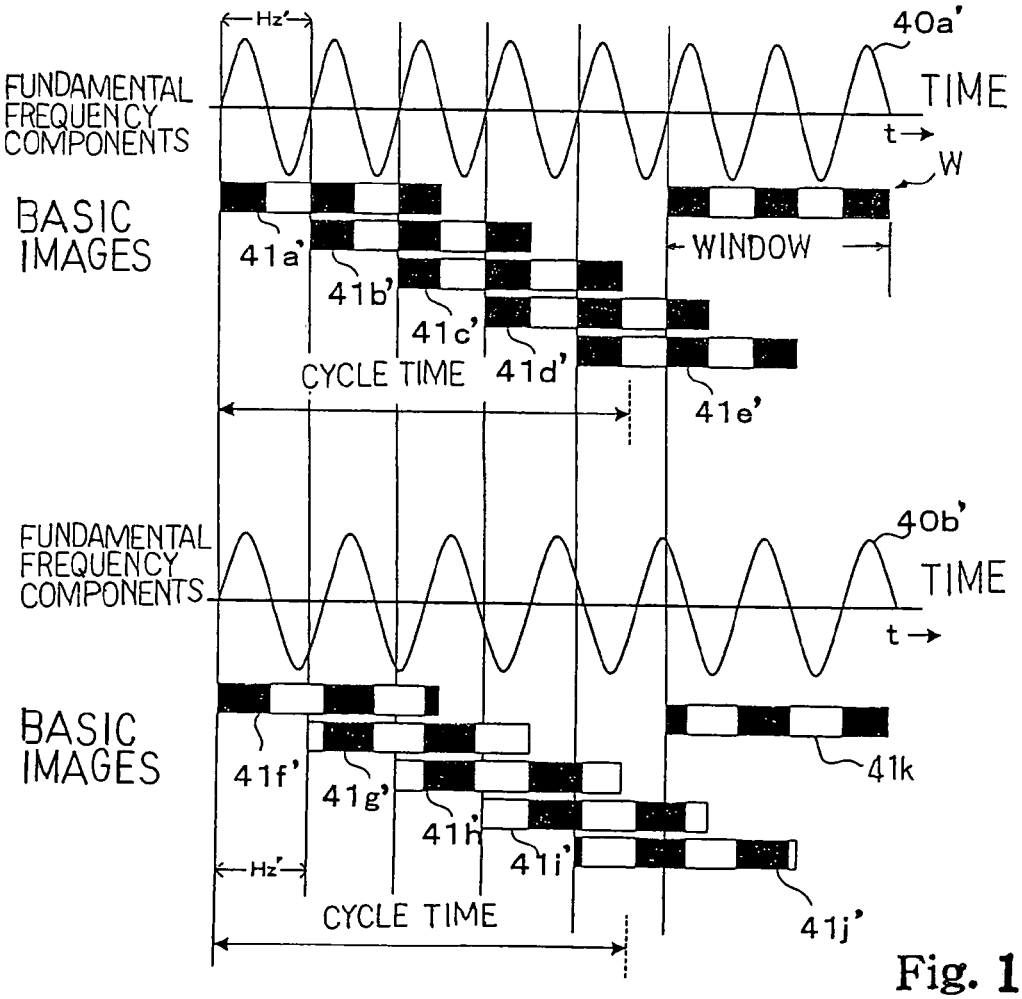
FIG. 16 is a graph showing relation between fundamental frequency components and basic images.

Subsequently, the plural series of fundamental frequency data are respectively converted to plural series of polarity data as by step S27, and bit strings are left in the random access memory 12. In this instance, five series of polarity data or five bit strings are prepared for basic images 41*a*', 41*b*', 41*c*', 41*d*' and 41*e*' or 41*f*', 41*g*', 41*h*', 41*i*' and 41*j*' as shown in FIG. 16. In this instance, each series contains twenty-five pieces of polarity data, and twenty five addresses are also assigned to the twenty-five pieces of polarity data, respectively. Since each bit has either "1" or "0", the basic images is expressed by two tones, i.e., black and white.

Figure 17A:
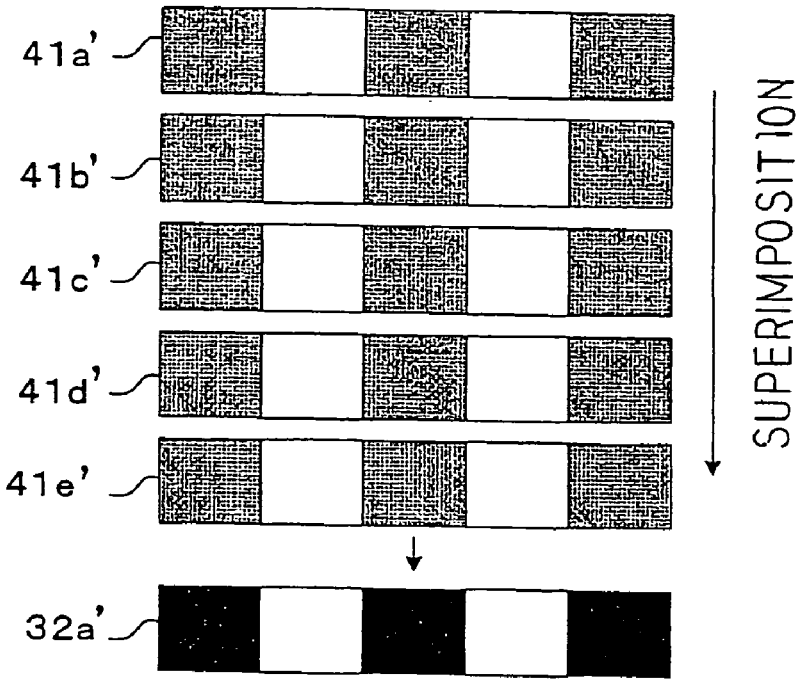
FIGS. 17A and 17B are views showing different basic images superimposed on one another.
Figure 17B:
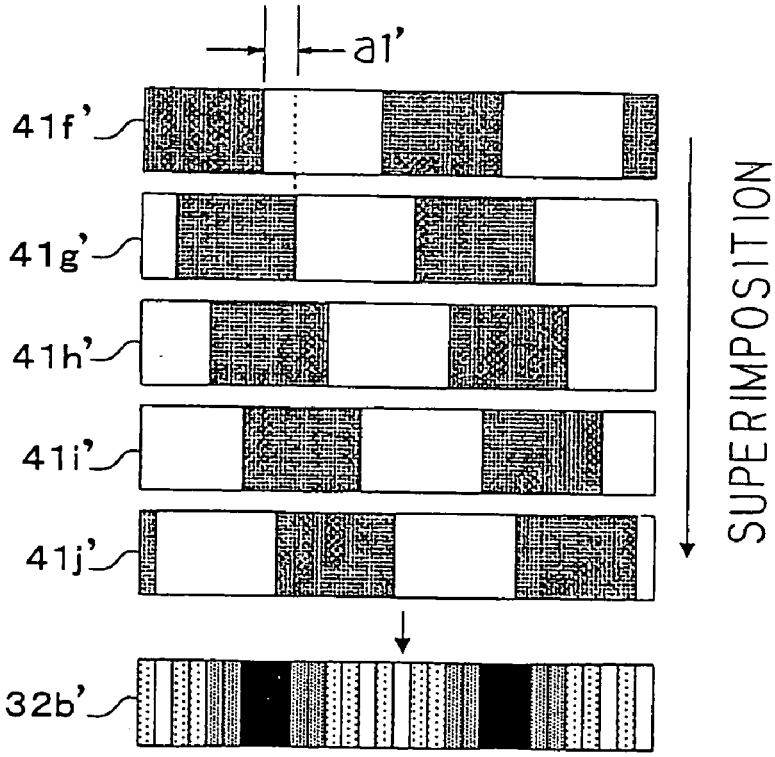

Subsequently, the central processing unit 10 superimposes the basic images 41*a*' to 41*e*' or 41*f*' to 41*j*' through the arithmetic mean on the bit strings as shown in FIGS. 17A and 17B. The bits at the head positions of the plural series are added to one another, the second bits are added to one another . . . , and the bits at the last positions are added to one another. If the fundamental frequency 40*a* is equal to the target frequency Hz, the boundaries between "1" and "0" are aligned with one another. However, when the fundamental frequency 40*b* is less than the target frequency Hz, the boundaries between "1" and "0" are offset from one another by a1'.

Figure 18A:
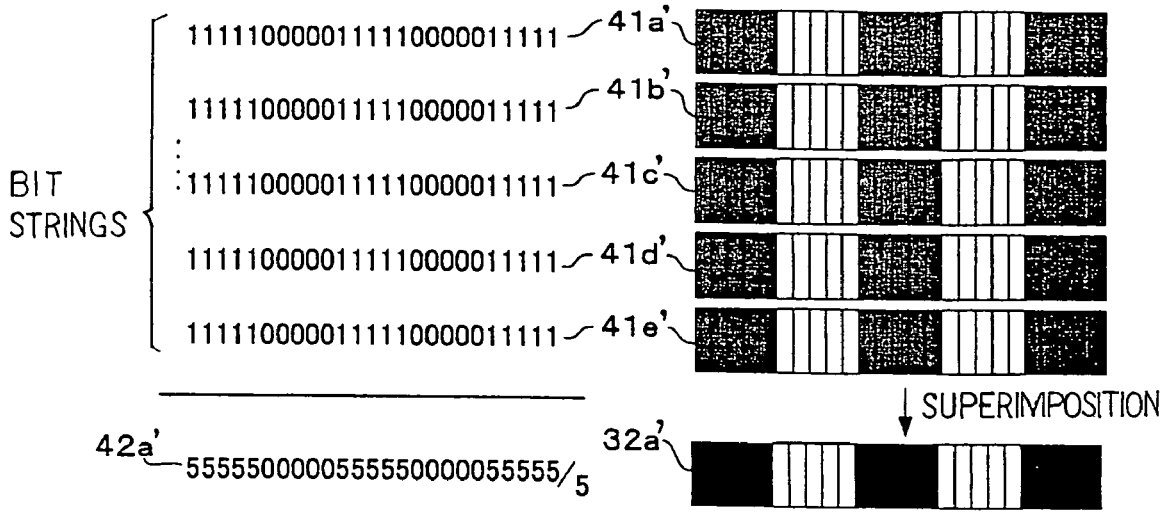
FIG. 18A and 18B are views showing relation among plural series of pieces of polarity data, basic images, a series of gradation data and a gradation image.
Figure 18B:
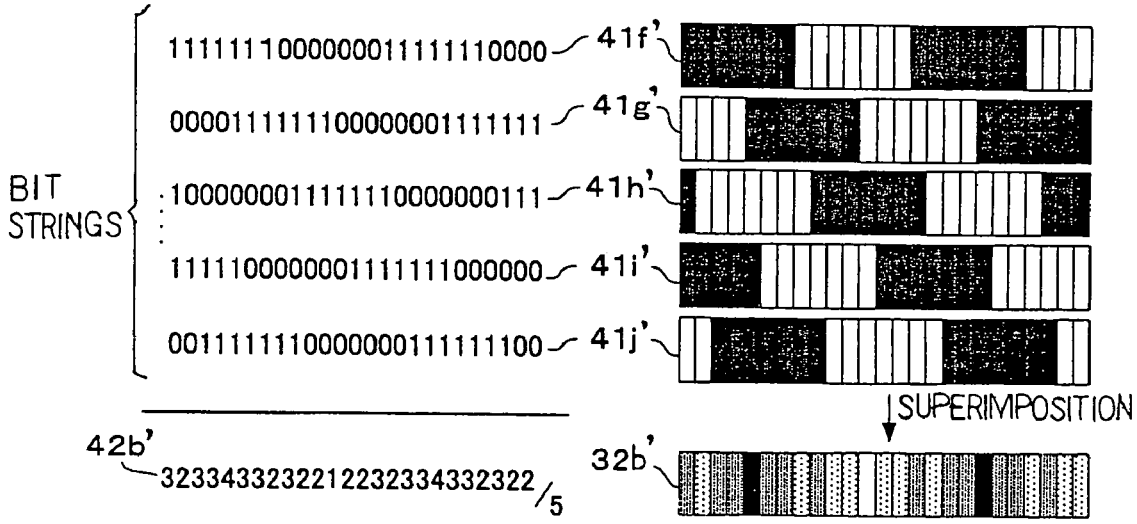

In more detail, the bit strings 41*a*', 41*b*', 41*c*', 41*d*' and 41*e*' are assumed to have 1s and 0s arranged as shown in FIG. 18A, and the bit strings 41*f*', 41*g*', 41*h*', 41*i*' and 41*j*' are assumed to have 1s and 0s arranged as shown in FIG. 18B. Although a bit string 42*a*', which expresses a gradation image 32*a*', is identical with the bit strings 41*a*' to 41*e*' at the consistency between the fundamental frequency 40*a* and the target frequency Hz, a bit string 42*b*', which expresses a gradation image 32*b*', is different from the bit strings 41*f*' to 41*j*' at the inconsistency between the fundamental frequency and the target frequency Hz.

In the bit strings 41*a*' to 41*e*', the first bit to fifth bit are "1" in each of the five bit strings 41*a*' to 41*e*', the sixth bit to tenth bit are "0", the eleventh bit to fifteenth bit are "1", the sixteenth bit to twentieth bit are "0", and the twenty-first bit to twenty-fifth bit are "1". When the first bit to the twenty fifth bit of the first bit string 41*a*' are added to the first bits to the twenty-first bits of the other bit strings 41*b*' to 41*e*', the sum is expressed as "5555500000555550000055555". The arithmetic mean is given through the division by 5 so that the bit string "111110000011111000011111" stands for a series of pieces of gradation data 42$a'$. The series of pieces of gradation data 42$a'$ has the bit string identical with the bit strings of the plural series of polarity data 41$a'$, 41$b'$ 41$c'$, 41$d'$ and 41$e'$. For this reason, a gradation image 32$a'$ is same as the basic images 41$a'$ to 41$e'$ at the consistency between the fundamental frequency and the target frequency Hz. The gradation image 32$a'$ is expressed by only two tones.

On the other hand, the plural series of pieces of polarity data have bit strings "111111100000001111111110000", "000011111100000001111111", "100000001111111000000111", "111110000000111111000000" and "001111111000000011111100", respectively. The sum of the first bits is "3", sum of the second bits is "2", . . . and sum of the twenty-fifth bits is "2". The sum of five series of polarity data is expressed as "32334332322 12232334332322", and the arithmetic mean, which expresses a series of gradation data 42$b'$, has the bit string "3233433232212232334332322/5". Comparing the bit string 42$b'$ with the bit strings 41$f'$ to 41$j'$, we find that the four values (4/5, 3/5, 2/5, 1/5) are incorporated in the bit string 42$b'$. Accordingly, a gradation image, which expresses the inconsistency between the fundamental frequency and the target frequency Hz, contains four tones. Thus, the central processing unit 10 produces the pieces of gradation data 42$a'$ or 42$b'$ through the arithmetic mean on the bit strings 41$a'$ to 41$e'$ or 41$f'$ to 41$j'$ as by step S28.

Finally, the central processing unit 10 supplies the pieces of gradation data 42$a'$ or 42$b'$ to the graphic controller 14, and the graphic controller 14 produces the gradation image 32$a'$ or 32$b'$ on the area 31 as by step S29.

The main routine program periodically branches to the subroutine program SB1', and the gradation image 32$a'$ or 32$b'$ is periodically renewed in the area 31.

As will be understood from the foregoing description, if the audio signal has the fundamental frequency greater than or less than the target frequency Hz, the user sees the gradation image moving in the area 31 and constituted by more than two tones. In case where the cycle time is equal to a common multiple between the inverse of the fundamental frequency and the inverse Hz' of target frequency, the gradation image looks as if it stops regardless of the consistency between the fundamental frequency and the target frequency. Nevertheless, the gradation image is constituted by more than two tones. For this reason, the user recognizes the inconsistency by the aid of the gradation image constituted by more than two tones. When the cycle time is not equal to the common multiples, the user sees the gradation image, which is constituted by more than two tones, moving in the area. Thus, the user surely recognizes the inconsistency in so far as the fundamental frequency is different from the target frequency Hz.

Modifications of Second embodiment

The second modification to tenth modification are also appropriate to the second embodiment. The steps S10, S11 and S25 may be deleted from the computer program shown in FIGS. 14 and 15. In this modification, the gradation images are always produced in an ordinary size so that the computer program is simpler than the computer programs shown in FIGS. 14 and 15. When the fundamental frequency is different from the target frequency Hz, the portable tuning device notifies the user of the inconsistency through the more than two tone gradation image and movement of the gradation image.

Although particular embodiments of the present invention have been shown and described, it will be apparent to those skilled in the art that various changes and modifications may be made without departing from the spirit and scope of the present invention.

Steps S1 to S5 may take place in different orders in other main routines employable in the portable tuning device.

Another potable tuning device according to the present invention may be used for a tuning work on a stringed instrument such as the violin family.

The microphone does not set any limit to the technical scope of the present invention. The audio signal may be directly produced from the vibrations of strings. Such a vibration-to-electric signal converter may be a piezoelectric element. The liquid crystal display and touch-panel do not set any limit to the technical scope of the present invention. The array of LEDs is available for the tuning device according to the present invention, and actual button switches may be provided on the case of a tuning device.

In the above-described embodiments and modifications, the fundamental frequency components are extracted from the pieces of audio data. A tuning device according to the present invention may extract certain harmonic components instead of the fundamental frequency components. Of course, pieces of frequency data are to be in a certain relation to the pitch of the tone. However, the pieces of frequency data need not express the fundamental frequency of the tone. Thus, the fundamental frequency components do not set any limit to the technical scope of the present invention.

The component elements and jobs of the above-described embodiments and modifications illustrated in the drawings are correlated with claim languages as follows. The pianos 2 and 2A are corresponding to a "musical instrument", and the microphones 4 and 4A serve as a "converter". The sound waves have "vibrations representative of a tone". The fundamental frequency is corresponding to an "actual frequency". The central processing unit 10 and jobs at S20 to S24 and S26 to S28 as a whole constitute an "inspector". The central processing unit 10, graphic controller 14 and jobs at step S29 as a whole constitute an "image producer", and the touch-panel liquid crystal display device 3 and 3A serves as a "visual interface". The central processing unit 10 and jobs at steps S2, S10, S11 and S25 or the central processing unit 10 and jobs at steps S30 to S32 as a whole constitute a "resolution controller".

The central processing unit 10 and jobs at steps S20 to S27 as a whole constitute a "basic image producer". The fundamental frequency components express for a "certain frequency", and the time period for each window is equivalent to a "window time period". The central processing unit 10, jobs at steps S28 and 29 and graphic controller 14 as a whole constitute a "composite image producer", and the gradation images 32$a$, 32$b$, 32$a'$ and 32$b'$ serve as a "composite image".

The central processing unit 10 and jobs at the timer interruption as a whole constitute a "time keeper", and the cycle time is equivalent to "time intervals".

The series of pieces of polarity data serves as "a series of pieces of waveform data", and the binary number "1" and binary number "0" are respectively corresponding to a "first value" and a "second value". The series of gradation data serves as "a series of composite data".

What is claimed is:

1. A tuning device for tuning a musical instrument to at least one target pitch, comprising:

a converter converting vibrations representative of a tone produced in said musical instrument to an electric signal representative of said vibrations;

an inspector connected to said converter, and comparing an actual frequency of said tone with a target frequency of said at least one pitch to see whether or not said tone has said at least one target pitch for producing a positive answer or a negative answer;

an image producer connected to said inspector, producing an image expressing said positive answer or said negative answer on a visual interface, and notifying users of difference between said actual frequency and said target frequency by making said image produced at said negative answer different from said image produced at said positive answer; and a resolution controller connected to said image producer, requesting said image producer to vary a resolution of said image so as to magnify a part of said image produced on said visual interface at said negative answer, and establishing a window time period for said image, wherein said tuning device further comprises a time keeper connected to said inspector and said image producer and causes said inspector repeatedly to produce said positive answer or said negative answer so that said image producer produces said image from basic images through superimposition of said basic images on said visual interface at time intervals longer than a window time period occupied by each of said basic images.

2. A tuning device for tuning a musical instrument to at least one target pitch, comprising:

a converter converting vibrations representative of a tone produced in said musical instrument to an electric signal representative of said vibrations;

an inspector connected to said converter, and comparing an actual frequency of said tone with a target frequency of said at least one pitch to see whether or not said tone has said at least one target pitch for producing a positive answer or a negative answer;

an image producer connected to said inspector, producing an image expressing said positive answer or said negative answer on a visual interface, and notifying users of difference between said actual frequency and said target frequency by making said image produced at said negative answer different from said image produced at said positive answer; and a resolution controller connected to said image producer, and requesting said image producer to vary a resolution of said image so as to magnify a part of said image produced on said visual interface at said negative answer, wherein said resolution controller establishes a window time period, and in which said inspector includes a basic image producer connected to said converter, and producing plural basic images representative of a repetition period of said actual frequency of said tone in such a manner that window time periods of said basic images are partially overlapped with one another, and a composite image producer producing said images from said basic images through superimposition of said basic images.

3. The tuning device as set forth in claim 2, further comprising a time keeper connected to said basic image producer, said composite image producer and said image producer and causing said basic image producer, said composite image producer and image producer repeatedly to produce said basic images and said image at time intervals longer than a window time period occupied by each of said basic images.

4. A tuning device for tuning a musical instrument to at least one target pitch, comprising:

a converter converting vibrations representative of a tone produced in said musical instrument to an electric signal representative of said vibrations;

a controller that establishes a window time period;

a basic image producer connected to said converter, and producing plural basic images representative of a repetition period of a certain frequency component incorporated in said tone in such a manner that window time periods of said basic images are partially overlapped with one another; and a composite image producer connected to said basic image producer, superimposing said basic images so as to form said basic images into a composite image, and producing said composite image on a visual interface.

5. The tuning device as set forth in claim 4, in which said basic image producer produces each of said basic images from a series of pieces of waveform data assigned respective data positions, said composite image producer produces said composite image from a series of pieces of composite data, and each of said pieces of composite data is produced through an arithmetic operation on the pieces of waveform data each occupied at one of said data positions in one of the plural series of pieces of waveform data.

6. The tuning device as set forth in claim 5, in which said arithmetic operation is an arithmetic mean.

7. The tuning device as set forth in claim 5, in which said series of pieces of waveform data are varied within a numeral range, and said series of composite data are variable within another numeral range wider than said numeral range through the superimposition.

8. The tuning device as set forth in claim 7, in which said series of composite data are varied within a sub-numeral range of said another numeral range identical with said numeral range when said tone has said target pitch, and said series of composite data are varied within said another numeral range so that selected ones of the pieces of composite data have a numeral or numerals out of said numeral range when said tone has a pitch different from said target pitch.

9. The tuning device as set forth in claim 4, further comprising a time keeper connected to said basic image producer and said composite image producer and causing said basic image producer and said composite image producer to produce said basic images and said composite image at time intervals longer than each of said window time periods.

10. The tuning device as set forth in claim 9, in which the superimposition is carried out through an arithmetic operation on plural series of pieces of waveform data respectively expressing said basic images, and values of the pieces of composite data are varied from one of said time intervals to the next time interval when said tone has a pitch different from said target pitch, whereby the composite image producer makes said composite image varied from said one of said time intervals to said next time interval.

11. A computer-readable medium storing a computer program expressing a method for assisting a user in a tuning work on a musical instrument, comprising:

a) acquiring at least a piece of target data expressing a target pitch;

b) establishing a window time period and producing plural basic images representative of a repetition period of a certain frequency component incorporated in said tone in such a manner that window time periods of said basic images are partially overlapped with one another;

c) superimposing said basic images so as to produce a composite image; and d) producing said composite image on a visual interface.

12. The computer-readable medium as set forth in claim 11, in which said steps b) and c) include the sub-steps of b-1) extracting plural series of pieces of waveform data from an electric signal representative of said tone, each of said plural series of pieces of waveform data occupying one of said window time periods, b-2) assigning values in a numerical range to said pieces of waveform data of each of said plural series, b-3) producing said basic images expressing strings of values of said plural series of pieces of waveform data, and c-1) carrying out an arithmetic operations on said values of the pieces of waveform data occupying data positions corresponding to one another in said plural series for producing a series of pieces of composite data expressing said composite image, each of the pieces of composite data having one of the values in said numerical range when said tone has said target pitch, each of said pieces of composite data having one of the values in another numerical range wider than said numerical range when said tone has a pitch different from said target pitch.

13. The computer-readable medium as set forth in claim 12, in which said arithmetic operation is an arithmetic mean.

14. The computer-readable medium as set forth in claim 12, further comprising the step of e) repeating said steps b), c) and d) at time intervals longer than each of said window time periods.

* * * * *